US010398216B2

(12) United States Patent
Davies-Smith et al.

(10) Patent No.: US 10,398,216 B2
(45) Date of Patent: Sep. 3, 2019

(54) FLUID SUPPLY APPARATUS AND PERSONAL CARE IMPLEMENT CONTAINING THE SAME

(71) Applicant: COLGATE-PALMOLIVE COMPANY, New York, NY (US)

(72) Inventors: Leighton Davies-Smith, Lebanon, NJ (US); Al Sprosta, Maplewood, NJ (US); Shyamala Pillai, Hillsborough, NJ (US)

(73) Assignee: Colgate-Palmolive Company, New York, NY (US)

( * ) Notice: Subject to any disclaimer, the term of this patent is extended or adjusted under 35 U.S.C. 154(b) by 69 days.

(21) Appl. No.: 15/840,825

(22) Filed: Dec. 13, 2017

(65) Prior Publication Data

US 2018/0168330 A1 Jun. 21, 2018

Related U.S. Application Data

(60) Provisional application No. 62/436,799, filed on Dec. 20, 2016.

(51) Int. Cl.
*A46B 11/04* (2006.01)
*A46B 11/00* (2006.01)
(Continued)

(52) U.S. Cl.
CPC ..... *A46B 11/0079* (2013.01); *A46B 9/04* (2013.01); *A46B 11/002* (2013.01);
(Continued)

(58) Field of Classification Search
CPC ..... A46B 11/002; A46B 11/0062; A46B 11/0072; A46B 11/0079; A46B 2200/1066
(Continued)

(56) References Cited

U.S. PATENT DOCUMENTS 1,973,212 A 9/1934 Krueger
3,741,668 A 6/1973 Danjzcek et al.
(Continued)

FOREIGN PATENT DOCUMENTS

CN 2382559 6/2000
DE 2754338 6/1979
(Continued)

OTHER PUBLICATIONS

International Search Report and Written Opinion of the International Searching Authority in International Application No. PCT/US2017/066148, dated Apr. 20, 2018.

*Primary Examiner* — Jennifer C Chiang

(57) ABSTRACT

A fluid supply apparatus with leakage protection. The apparatus includes a housing defining a storage cavity having a total volume including a fluid portion and a gas portion. The storage cavity extends along a cavity axis from a first end to a second end. A capillary member is fluidly coupled with the fluid. A vent tube having a primary vent passageway and a plurality of vent apertures is located in the storage cavity. The primary vent passageway forms a pathway from the vent apertures to the external atmosphere. Fluid cannot flow through the vent apertures at ambient temperature and pressure equilibrium. The vent apertures may be located and arranged on the vent tube such that irrespective of vertical and angular orientation of the housing relative to a gravitational vector at least one of the vent apertures is in spatial communication with the gas.

20 Claims, 13 Drawing Sheets

(51) Int. Cl.
*A46B 9/04* (2006.01)
*A46B 15/00* (2006.01)

(52) U.S. Cl.
CPC ..... *A46B 11/0062* (2013.01); *A46B 15/0051* (2013.01); *A46B 2200/1066* (2013.01)

(58) Field of Classification Search
USPC ..... 401/198, 270
See application file for complete search history.

(56) References Cited

U.S. PATENT DOCUMENTS

| | | | |
|---|---|---|---|
| 4,155,663 | A | 5/1979 | Cerquozzi |
| 4,207,012 | A | 6/1980 | Kuparinen |
| 4,530,369 | A | 7/1985 | Adams |
| 4,753,546 | A | 6/1988 | Witz et al. |
| 4,770,558 | A | 9/1988 | Frietsch |
| 4,886,389 | A | 12/1989 | Vidovic |
| 5,033,898 | A | 7/1991 | Williams |
| 5,062,728 | A | 11/1991 | Kuo |
| 5,096,319 | A | 3/1992 | Gueret |
| 5,098,297 | A | 3/1992 | Chari et al. |
| D337,659 | S | 7/1993 | Lacy |
| 5,242,233 | A | 9/1993 | Sirota |
| 5,611,687 | A | 3/1997 | Wagner |
| 6,345,405 | B1 | 2/2002 | Brackin |
| 6,371,674 | B1 | 4/2002 | Lerner |
| 6,416,242 | B1 | 7/2002 | Kaufmann |
| 6,699,038 | B2 | 3/2004 | Stewart |
| 7,887,246 | B2 | 2/2011 | Hori |
| 8,398,326 | B2 | 3/2013 | Jimenez et al. |
| 8,529,150 | B2 | 9/2013 | Olson |
| 9,237,798 | B2 | 1/2016 | Kennedy et al. |
| 9,648,943 | B2 | 5/2017 | Jimenez et al. |
| 9,700,130 | B2 * | 7/2017 | Kennedy ..... A46B 15/0061 |
| 2002/0192007 | A1 | 12/2002 | Lee |
| 2004/0237226 | A1 | 12/2004 | Hohlbein et al. |
| 2004/0255416 | A1 | 12/2004 | Hohlbein |
| 2008/0014010 | A1 | 1/2008 | Bartschi et al. |
| 2017/0215574 | A1 | 8/2017 | Jimenez et al. |

FOREIGN PATENT DOCUMENTS

| | | |
|---|---|---|
| DE | 40 14642 | 4/1991 |
| DE | 100 35 214 | 2/2002 |
| EP | 0624483 | 11/1994 |
| EP | 1 017 297 | 6/2002 |
| FR | 2 448 982 | 9/1980 |
| GB | 801603 | 9/1958 |

* cited by examiner

FLUID SUPPLY APPARATUS AND PERSONAL CARE IMPLEMENT CONTAINING THE SAME

CROSS-REFERENCE TO RELATED APPLICATIONS

The present application claims the benefit of U.S. Provisional Application Ser. No. 62/436,799, filed Dec. 20, 2016, the entirety of which is incorporated herein by reference.

BACKGROUND

Fluid supply apparatuses are used to store a fluid that is later dispensed onto a surface. Examples of fluid supply apparatuses include writing instruments, liquid dispensers, liquid applicators, and the like. Personal care implements, particularly oral care implements such as toothbrushes, are typically used by applying dentifrice or toothpaste to tooth cleaning elements such as bristles followed by brushing regions of the oral cavity, e.g., the teeth, tongue, and/or gums. Some oral care implements have been equipped with fluid reservoirs and systems for dispensing auxiliary oral care fluids before and/or during the tooth brushing regimen. An issue with existing fluid supply apparatuses and personal care implements containing the same is leakage, particularly due to air expansion as a result of temperature increases or pressure decreases which forces the liquid to leak out of the device. An improved fluid supply apparatus and personal/oral care implement containing the same is desired to address existing unwanted fluid leaks.

BRIEF SUMMARY

The present invention is directed to a fluid supply apparatus with leakage protection. The apparatus includes a housing defining a storage cavity having a total volume including a fluid portion and a gas portion. The storage cavity extends along a cavity axis from a first end to a second end. A capillary member is fluidly coupled with the fluid. A vent tube having a primary vent passageway and a plurality of vent apertures is located in the storage cavity. The primary vent passageway forms a pathway from the vent apertures to the external atmosphere. Fluid cannot flow through the vent apertures at ambient temperature and pressure equilibrium. The vent apertures may be located and arranged on the vent tube such that irrespective of vertical and angular orientation of the housing relative to a gravitational vector at least one of the vent apertures is in spatial communication with the gas.

In one aspect, the invention may be a fluid supply apparatus comprising: a housing defining a storage cavity having a total volume, the storage cavity extending along a cavity axis from a first end to a second end; a store of a fluid in the storage cavity and occupying a portion of the total volume, a remaining portion of the total volume occupied by a gas; a capillary member in fluid coupling with the store of the fluid, the capillary member extending through the housing; a vent tube comprising a primary vent passageway and a plurality of vent apertures, each of the vent apertures forming a passageway between the storage cavity and the primary vent passageway, the primary vent passageway forming a pathway between each of the vent apertures and an external atmosphere, and the vent apertures configured such that the fluid cannot flow through the vent apertures at ambient temperature and pressure equilibrium between the storage cavity and the external atmosphere; and the vent apertures located and arranged on the vent tube such that irrespective of vertical and angular orientation of the housing relative to a gravitational vector at least one of the vent apertures is in spatial communication with the gas.

In another aspect, the invention may be a fluid supply apparatus comprising: a housing defining a storage cavity extending along a cavity axis from a first end to a second end; a capillary member having a portion in the storage cavity and a portion extending through the housing; a vent tube comprising a primary vent passageway and a plurality of vent apertures, each of the vent apertures forming a passageway between the storage cavity and the primary vent passageway, the primary vent passageway forming a pathway between each of the vent apertures and an external atmosphere, the vent apertures comprising a plurality of first vent apertures radially spaced from the cavity axis and arranged in a spaced apart manner to circumferentially surround the cavity axis.

The fluid supply apparatus may be located within a handle of an oral care implement such the housing of the fluid supply apparatus forms a portion of the handle or is formed by the handle.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
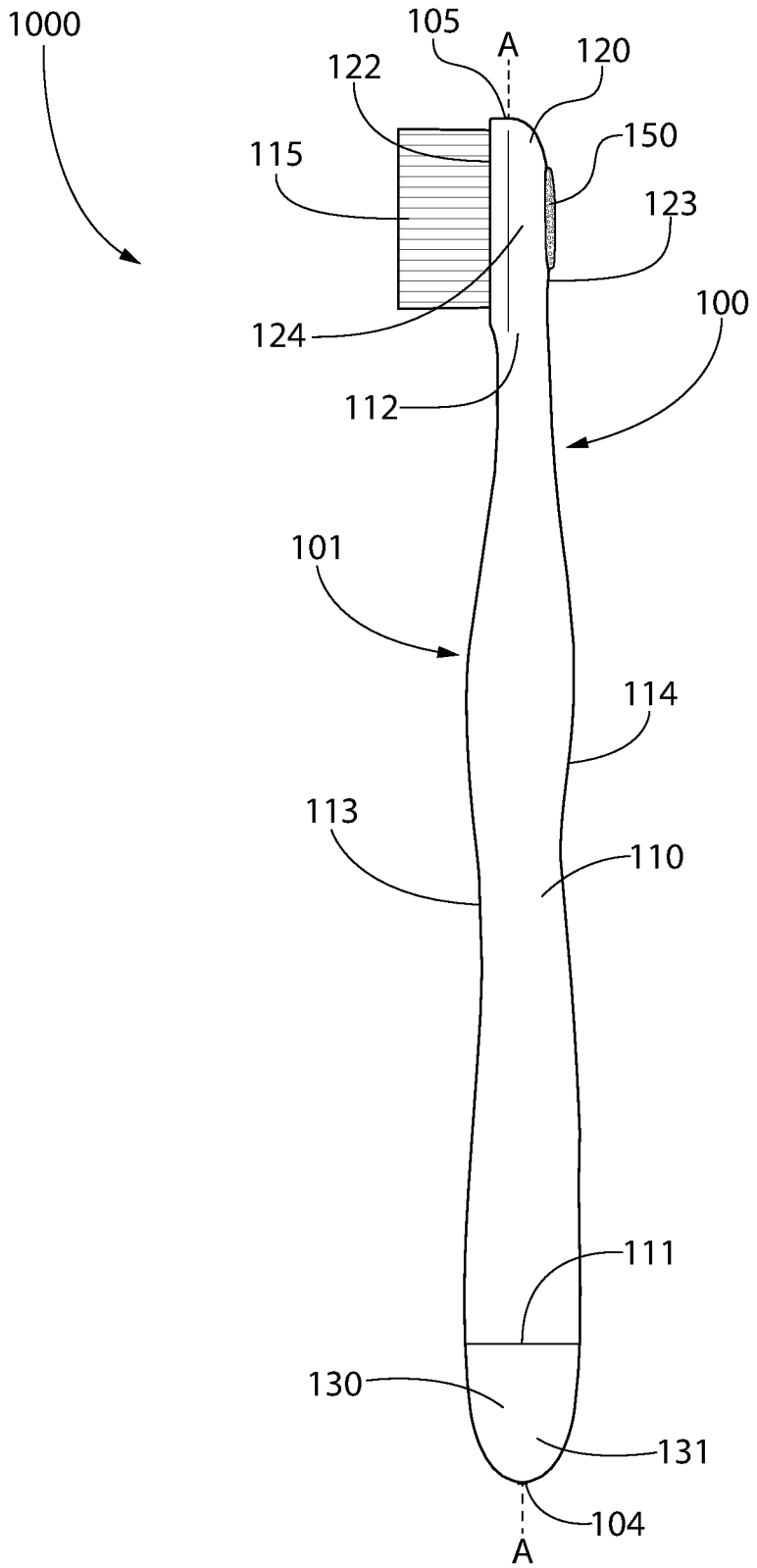
FIG. 1 is side view of a personal care implement in accordance with an embodiment of the present invention.
Figure 2:
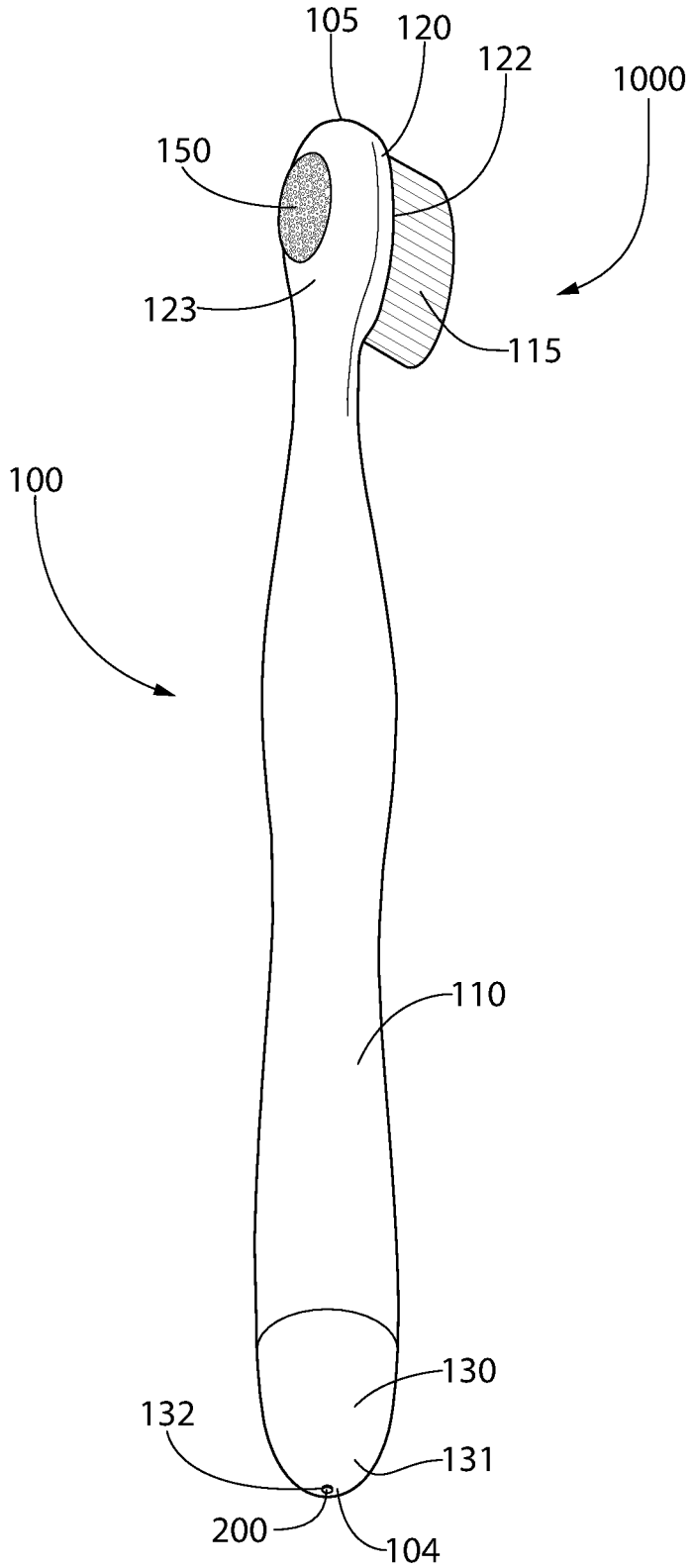
FIG. 2 is a rear perspective view of the personal care implement of FIG. 1.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

Referring first to FIGS. 1-5B, a fluid supply apparatus 1000 is illustrated in accordance with an embodiment of the present invention. In the exemplified embodiment, the fluid supply apparatus 1000 is in the form of a personal care implement 100, or stated another way the personal care implement 100 comprises the fluid supply apparatus 1000. The fluid supply apparatus 1000, or the personal care implement 100 comprising the same, is designed to store a fluid and to dispense the fluid onto a desired surface. As used herein, the term fluid is includes liquids and excludes gases. The fluid supply apparatus 1000 includes mechanisms that facilitate flow of the fluid from its stored location to another location at which the fluid is dispensed in a desired manner. As described more fully herein, the fluid supply apparatus 1000 is specifically configured to prevent fluid leakage regardless of the orientation at which the fluid supply apparatus 1000 is held under any normal usage and storage conditions including through changes in temperature and pressure. Although described herein as being a part of a personal care implement, the invention is not to be so limited and the fluid supply apparatus 1000 may be a stand-alone device that is not tied to a particular product type or it may be formed as a part of a different type of product.

In the exemplified embodiment, the personal care implement 100 is an oral care implement, and more specifically a manual toothbrush. Thus, the invention will be described herein with the details predominately directed to a toothbrush. However, in certain other embodiments the personal care implement 100 can take on other forms such as being a powered toothbrush, a tongue scraper, a gum and soft tissue cleanser, a water pick, an interdental device, a tooth polisher, a specially designed ansate implement having tooth engaging elements, or any other type of implement that is commonly used for oral care. Still further, the personal care implement 100 may not be one that is specifically used for oral care in all embodiments, but rather it may be an implement such as a deodorant application implement, a face or body cleaning implement, a make-up applicator implement, a razor or shaving implement, a hairbrush, or the like. Thus, it is to be understood that the inventive concepts discussed herein can be applied to any type of personal care implement unless a specific type of personal care implement is specified in the claims. Furthermore, in some embodiments the invention is directed solely to the fluid supply apparatus 1000. Thus, the fluid supply apparatus 1000 may be included as a part of the personal care implement 100 or it may be a separate, stand-alone device. When a stand-alone device, the fluid supply apparatus 1000 may include some type of applicator so that the fluid/liquid dispensed from the fluid supply apparatus 1000 can be properly applied to a desired surface.

In the exemplified embodiment, the personal care implement 100 generally includes a body 101 comprising a handle 110 and a head 120 and an end cap 130 that is detachably coupled to the handle 110. The personal care implement 100 generally extends along a longitudinal axis A-A from a proximal end 104 to a distal end 105. Conceptually, the longitudinal axis A-A is a reference line that is generally coextensive with the three-dimensional center line of the body 101. Because the body 101 may, in certain embodiments, be a non-linear structure, the longitudinal axis A-A of the body 101 may also be non-linear in certain embodiments. However, the invention is not to be so limited in all embodiments and in certain other embodiments the body 101 may have a simple linear arrangement and thus a substantially linear longitudinal axis A-A.

The handle 110 extends from a proximal end 111 to a distal end 112 and the head 120 is coupled to the distal end 112 of the handle 110. In the exemplified embodiment, the end cap 130 is detachably coupled to the proximal end 111 of the handle 120. Specifically, the handle 120 has an opening 116 at the proximal end 111 thereof and the end cap 130 is coupled to the proximal end 111 of the handle 120 and closes the opening 116. The end cap 130 may be detachable from the handle 120 so that a fluid or oral care material can be stored within the body 101 and can be refilled by detaching the end cap 130 from the handle 110 to provide access, via the opening 116, to a cavity/reservoir within the body 101 within which the fluid may be stored. Furthermore, in certain embodiments the end cap 130 may be altogether omitted and the proximal end 111 of the body 101 may form a closed bottom end of the personal care implement 100. In such embodiments, refill of the reservoir may not be possible or may occur through other mechanisms/structures as would be understood to persons skilled in the art.

The handle 110 is an elongated structure that provides the mechanism by which the user can hold and manipulate the personal care implement 100 during use. The handle 110 comprises a front surface 113 and an opposing rear surface 114. In the exemplified embodiment, the handle 110 is generically depicted having various contours for user comfort. Of course, the invention is not to be so limited in all embodiments and in certain other embodiments the handle 110 can take on a wide variety of shapes, contours and configurations, none of which are limiting of the present invention unless so specified in the claims.

In the exemplified embodiment, the handle 110 is formed of a rigid plastic material, such as, for example without limitation, polymers and copolymers of ethylene, propylene, butadiene, vinyl compounds, and polyesters such as polyethylene terephthalate. Of course, the invention is not to be so limited in all embodiments and the handle 110 may include a resilient material, such as a thermoplastic elastomer, as a grip cover that is molded over portions of or the entirety of the handle 110 to enhance the gripability of the handle 110 during use. For example, portions of the handle 110 that are typically gripped by a user's palm during use may be overmolded with a thermoplastic elastomer or other resilient material to further increase comfort to a user.

The head 120 of the personal care implement 100 is coupled to the handle 110 and comprises a front surface 122, an opposing rear surface 123, and a peripheral surface 124 extending between the front and rear surfaces 122, 123. In the exemplified embodiment, the head 120 is formed integrally with the handle 110 as a single unitary structure using a molding, milling, machining or other suitable process. However, in other embodiments the handle 110 and the head 120 may be formed as separate components which are operably connected at a later stage of the manufacturing process by any suitable technique known in the art, including without limitation thermal or ultrasonic welding, a tight-fit assembly, a coupling sleeve, threaded engagement, adhesion, or fasteners. In some embodiments the head 120 may be detachable from the handle 110. The head 120 may be formed of any one of the materials discussed above with regard to the handle 110.

In the exemplified embodiment, the head 120 of the personal care implement 100 is provided with a plurality of tooth cleaning elements 115 extending from the front surface 122. Of course, depending on the particular type of device selected for the personal care implement 100, the tooth cleaning elements 115 may be replaced with some other bristle-like elements (for example when the personal care implement 100 is a hairbrush or a mascara applicator) or may be altogether omitted.

In the exemplified embodiment the tooth cleaning elements 115 are generically illustrated. In certain embodiments the exact structure, pattern, orientation and material of the tooth cleaning elements 115 are not to be limiting of the present invention. Thus, as used herein, the term "tooth cleaning elements" is used in a generic sense to refer to any structure that can be used to clean, polish or wipe the teeth and/or soft oral tissue (e.g. tongue, cheek, gums, etc.) through relative surface contact. Common examples of "tooth cleaning elements" include, without limitation, bristle tufts, filament bristles, fiber bristles, nylon bristles, spiral bristles, rubber bristles, elastomeric protrusions, flexible polymer protrusions, combinations thereof, and/or structures containing such materials or combinations. Suitable elastomeric materials include any biocompatible resilient material suitable for uses in an oral hygiene apparatus. To provide optimum comfort as well as cleaning benefits, the elastomeric material of the tooth or soft tissue engaging elements has a hardness property in the range of A8 to A25 Shore hardness. One suitable elastomeric material is styrene-ethylene/butylene-styrene block copolymer (SEBS) manufactured by GLS Corporation. Nevertheless, SEBS material from other manufacturers or other materials within and outside the noted hardness range could be used.

Figure 3:
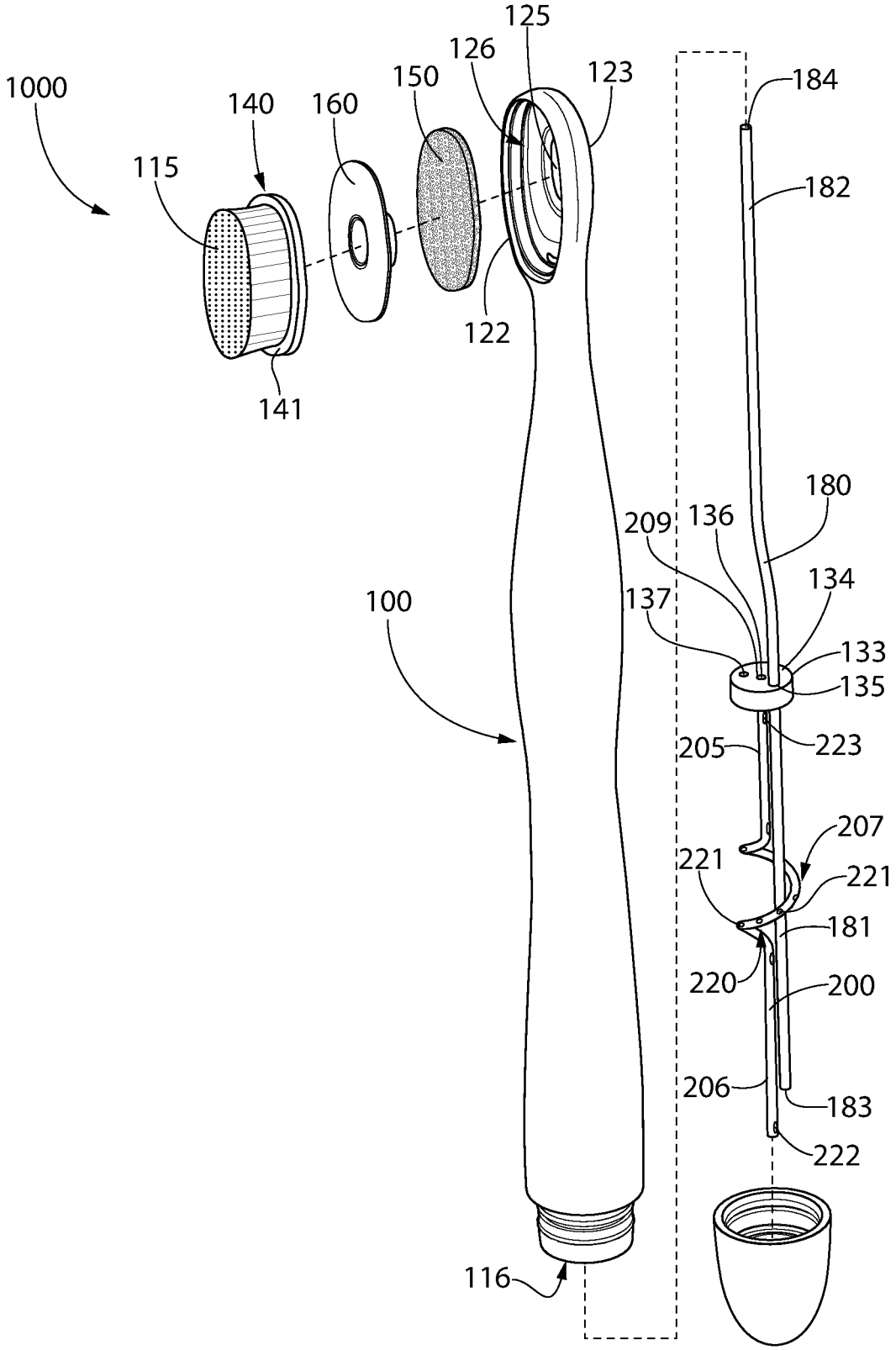
FIG. 3 is an exploded front perspective view of the personal care implement of FIG. 1.
Figure 4:
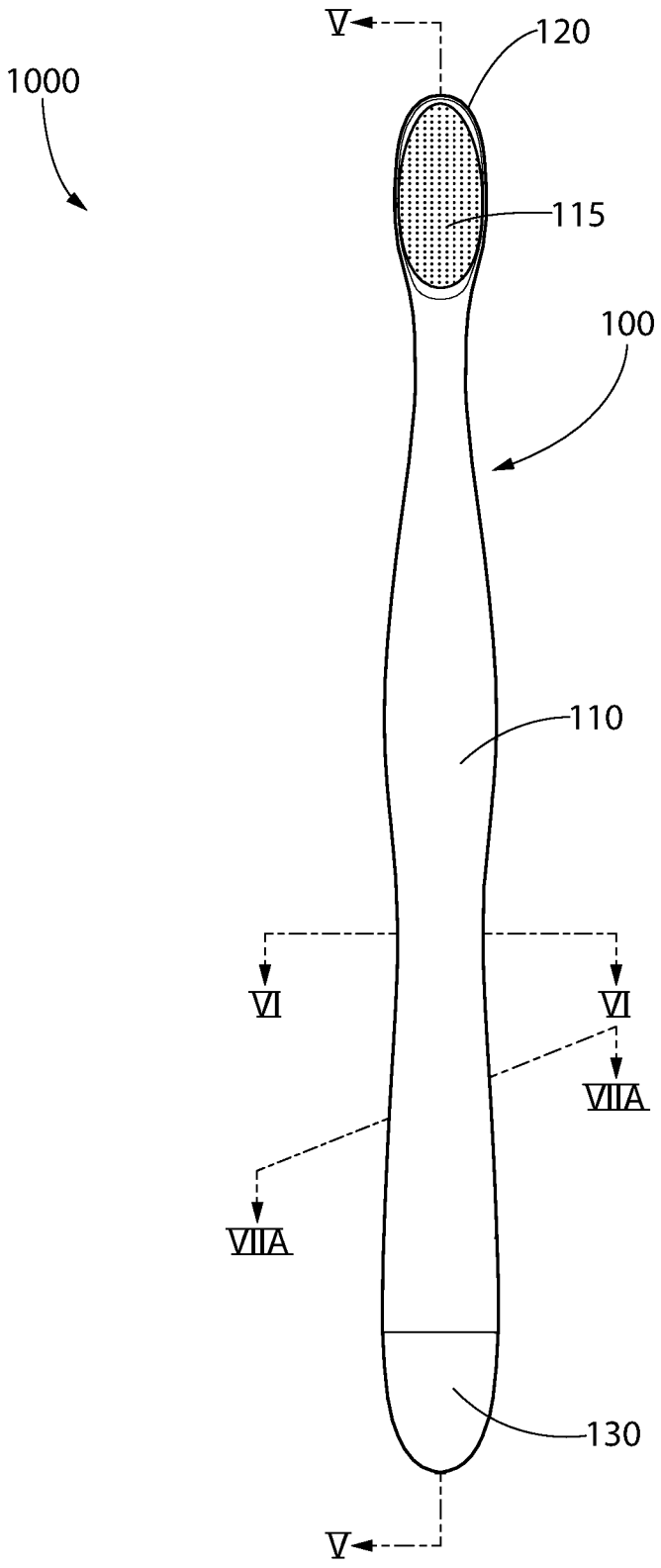
FIG. 4 is a front view of the personal care implement of FIG. 1.
Figure 5A:
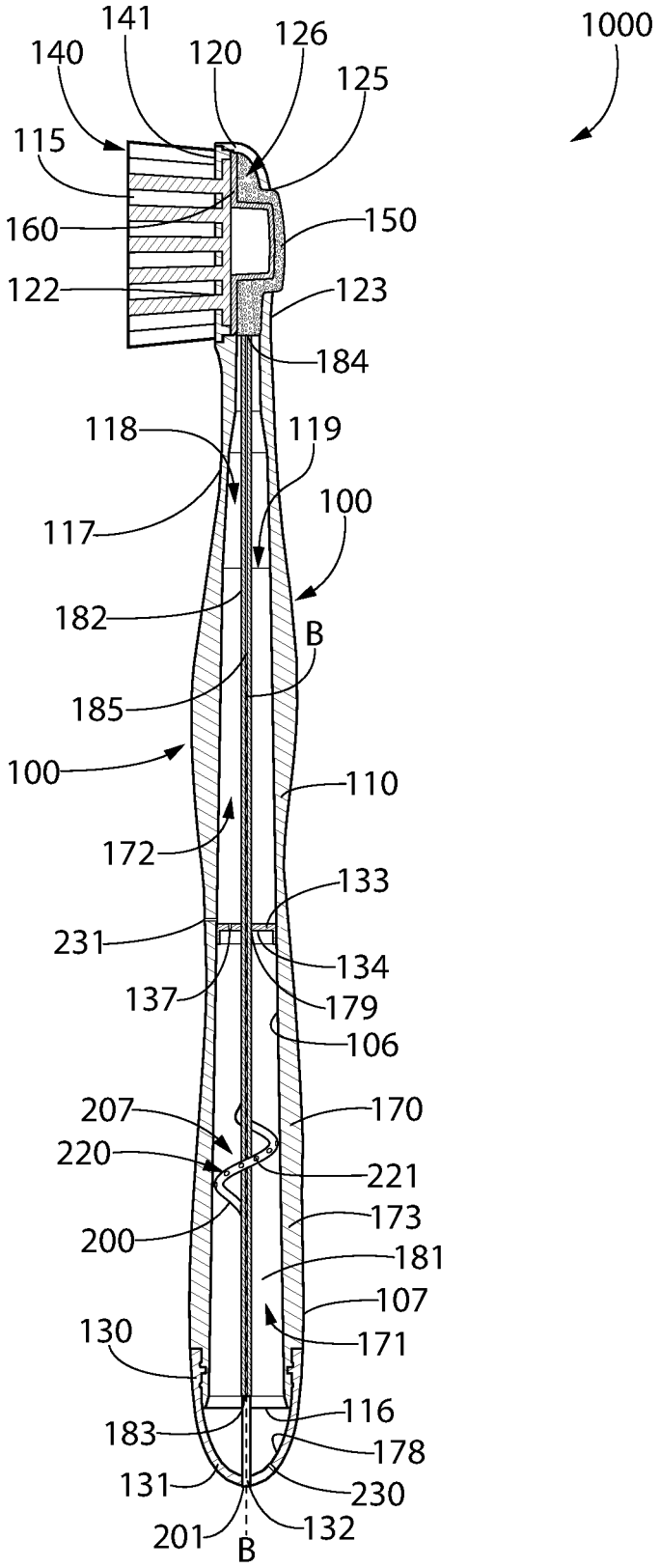
FIGS. 5A and 5B are cross-sectional views taken along line V-V of FIG. 4.
Figure 5B:
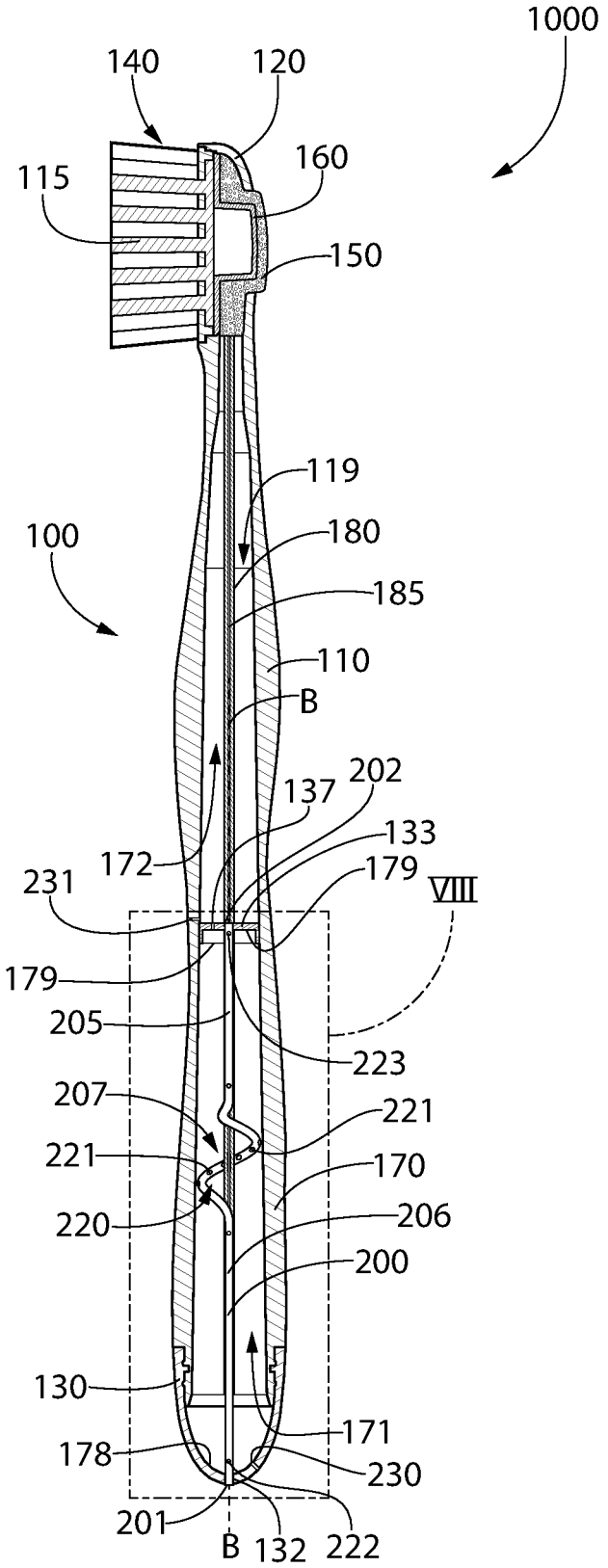

Referring briefly to FIGS. 3 and 5A, in the exemplified embodiment the tooth cleaning elements 115 are formed on a cleaning element assembly 140 that comprises a head plate 141 and the tooth cleaning elements 115 mounted thereon. In such an embodiment, the head plate 141 is a separate and distinct component from the body 101 of the personal care implement 100. However, the head plate 141 is connected to the body 101 at a later stage of the manufacturing process by any suitable technique known in the art, including without limitation thermal or ultrasonic welding, any fusion techniques such as thermal fusion, melting, a tight-fit assembly, a coupling sleeve, threaded engagement, adhesion, or fasteners. Thus, the head plate 141 and the body 101 are separately formed components that are secured together during manufacture of the personal care implement 100. More specifically, the tooth cleaning elements 115 are secured to the head plate 141 in a manner known in the art (i.e., anchor free tufting or AFT) to form the cleaning element assembly 140, and then the cleaning element assembly 140 is coupled to the head 120. Alternatively, the tooth cleaning elements 115 may be connected to the head 120 using AMR techniques, stapling, or the like. The invention is not to be particularly limited by the manner in which the tooth cleaning elements 115 are coupled to the head 120 in all embodiments.

Although not illustrated herein, in certain embodiments the head 120 may also include a soft tissue cleanser coupled to or positioned on its rear surface 123. An example of a suitable soft tissue cleanser that may be used with the present invention and positioned on the rear surface 123 of the head 120 is disclosed in U.S. Pat. No. 7,143,462, issued Dec. 5, 2006 to the assignee of the present application, the entirety of which is hereby incorporated herein by reference. In certain other embodiments, the soft tissue cleanser may include protuberances, which can take the form of elongated ridges, nubs, or combinations thereof. Of course, the invention is not to be so limited and in certain embodiments the personal care implement 100 may not include any soft tissue cleanser.

Referring again to FIGS. 1-5B concurrently, in the exemplified embodiment the personal care implement 100 comprises an applicator 150 protruding from the rear surface 123 of the head 120. More specifically, the head 120 has an opening 125 that extends from the rear surface 123 of the head 120 into a basin cavity 126 of the head 120. The applicator 150 is inserted into the basin cavity 126 of the head 120 and extends through the opening 125 and protrudes from the rear surface 123 of the head 120. Thus, during use of the personal care implement 100 to brush teeth, the applicator 150 will engage/contact the user's oral surfaces and dispense a fluid thereon as discussed in more detail below. The personal care implement 100 may also include a divider member 160 that divides the basin cavity 126 into an upper chamber and a lower chamber such that the cleaning element assembly 140 is located in the upper chamber and the applicator 150 is located in the lower chamber. The divider member 160 may seal the applicator 150 within the lower chamber so that any fluid loaded on the applicator 150 does not pass into the upper chamber.

The applicator 150 may be formed of a capillary material that is capable of being loaded with a fluid (i.e., a liquid) that can be dispensed from the applicator 150 when the applicator 150 is compressed. For example, the applicator 150 may be a porous foam such as including without limitation a polyurethane foam or other open cell porous material. Thus, in the exemplified embodiment the applicator 150 can be formed of any type of material through which a liquid can travel via capillary action or capillary flow. Specifically, the capillary material can be a porous material, a fibrous material, a foam material, a sponge material, natural fibers, sintered porous materials, porous or fibrous polymers or other materials which conduct the capillary flow of liquids. Of course, the capillary material is not to be limited by the specific materials noted herein in all embodiments, but can be any material that facilitates movement of a liquid therethrough via capillary action. Furthermore, although described herein as being formed of a capillary material, the invention is not to be so limited in all embodiments and some alternative embodiments will be described herein below. For example, in certain embodiments the applicator 150 may be formed of a plastic material or a rubber material and may have an orifice formed therethrough to enable the fluid to flow through the applicator for application to a biological surface such as a user's oral cavity, facial surfaces, or the like.

The fluid supply apparatus 1000 generally comprises a housing 170 that defines a storage cavity 171 for storing a fluid/liquid that is dispensed via the applicator 150 as described herein, a capillary member 180, and a vent tube 200. The storage cavity 171 extends along a cavity axis B-B from a first end 178 to a second end 179. The storage cavity 171 is designed to hold a store of a fluid/liquid as discussed in greater detail below with reference to FIGS. 8A-8D. The capillary member 180 is designed to flow or otherwise transport the fluid/liquid from the storage cavity 171 to the applicator 150 or other desired location for dispensing onto a desired surface. The vent tube 200 is designed to permit air to replace fluid/liquid that is dispensed from the storage cavity during use to ensure consistent fluid flow and to vent the storage cavity 171 to prevent air from expanding within the storage cavity 171 and causing the fluid to leak out in an undesired manner.

In the exemplified embodiment, the housing 170 forms a portion of the handle 110 of the personal care implement 100. However, the invention is not to be so limited in all embodiments and the housing 170 could be a separate component from the handle 110 in other embodiments. For example, in one alternative embodiment the housing 170 could be a stand-alone device such as a cartridge that is insertable into a cavity of the handle 110 of the personal care implement 100. In such an embodiment the housing 170 would not form any portion of the handle 110, but rather it would be wholly retained therein. In another embodiment the housing 170 could be a stand-alone device that operates independently without being inserted into any separate product (such as the personal care implement 100). Thus, the housing 170 could include all features for storing the fluid and it may be coupled to or include additional features, such as an applicator, for applying the fluid to a desired surface without being coupled to or forming a part of a personal care implement.

In the exemplified embodiment the housing 170 comprises a tubular sidewall 173 that forms a portion of a gripping section of the handle 110, a first end wall 131 that forms the proximal end 104 of the personal care implement 100 (and also of the handle 110), and a divider component 133 having a second end wall 134 located within the interior of the handle 110. Specifically, the divider component 133 may be a separate component from the handle 110 and the housing 170 that is inserted into the handle 110 to form the upper-most bounds of the storage cavity 171. The divider component 133 may be formed of a rigid plastic material similar to the materials used to form the handle 110, or it may be formed from other materials such as rubber or other elastomeric materials. The divider component 133 may be securely placed within the interior of the handle 110 so that it is fixed relative to the handle 110 and forms a fixed upper boundary of the storage cavity 171. Techniques for fixing the divider component 133 within the handle 110 include interference fit, friction fit, protuberance/detent, adhesion, mechanical interlocking, or the like. In the exemplified embodiment because the housing 170 forms a portion of the handle 110, an inner surface 106 of the handle 110 is also the inner surface of the tubular sidewall 173 of the housing 170.

In the exemplified embodiment, the handle 110 defines an internal cavity 118 throughout its entire length. Thus, a large portion of the handle 110 is hollow thereby forming the internal cavity 118 of the handle 110. A first portion of the internal cavity 118 of the handle 110 forms the storage cavity 171 and a second portion of the internal cavity 118 of the handle 110 forms a venting cavity 119. The divider component 133 separates the storage cavity 171 from the venting cavity 119 while leaving the storage cavity 171 and the venting cavity 119 in spatial communication with one another either directly or via the venting tube 200.

Thus, in the exemplified embodiment, with the housing 170 forming a portion of the handle 110 of the personal care implement 100, the inner surface 106 of the handle 110 (which is also the inner surface of the housing 170) defines the storage cavity 171. The storage cavity 171 is closed at its bottom end via the end cap 130 that closes the opening 116 at the proximal end 111 of the handle 110. Specifically, the end cap 130 comprises the first end wall 131 that forms the proximal end 111 of the handle 110. In other embodiments the end cap 130 may be omitted but the handle 110 may nonetheless include the first end wall 131 that forms the proximal end 111 of the handle 110 and closes the bottom end of the storage cavity 171. As discussed in greater detail below, there is an opening at the top end of the storage cavity 171 that spatially couples the storage cavity 171 to the opening 125 in the head 120. More specifically, the storage cavity 171 is spatially coupled to the opening 125 in the head 120 via a passageway 172 that extends through the handle 110 and a neck region 117 of the personal care implement 100.

As noted above, the divider component 133 is inserted into the internal cavity 118 of the handle 110 to divide the internal cavity 118 into the storage cavity 171 and the venting cavity 119. The capillary member 180 is located in both the storage cavity 171 and the venting cavity 119. In that regard, the divider component 133 has a first opening 135 through which the capillary member 180 extends out of the housing 170 (i.e., out of the storage cavity 171) and into the neck region 117 of the personal care implement 100 (i.e., into the venting cavity 119 and the passageway 172). The divider component 133 has a second opening 136 into which the vent tube 200 extends. The divider component 133 may also include a third opening (i.e., a vent opening 137) that forms a vent aperture for venting the storage cavity 171 as discussed in more detail below. Specifically, the vent opening 137 in the divider member 133 forms a passageway between the storage cavity 171 and the venting cavity 119 to place the storage cavity 171 and the venting cavity 119 into spatial communication with one another so that air/gas can flow therebetween. The venting cavity 119 is vented to (i.e., in spatial communication with) the exterior environment via a handle vent aperture 231 as discussed more fully below. Of course, in certain embodiments the vent opening 137 may be omitted and air/gas flow between the storage cavity 171 and the venting cavity 119 may be achieved via the vent tube 200 as described in more detail below.

In the exemplified embodiment, an opening 132 is formed into the personal care implement 100 at the proximal end 104 thereof. Specifically, in the exemplified embodiment the opening 132 is formed into the bottom end of the end cap 130. However, if the end cap 130 were omitted the opening 132 would merely be formed into the proximal end 104 of the personal care implement 100. Alternatively, the opening 132 may be recessed relative to the proximal end 104 of the personal care implement 100 to prevent clogging from debris. In the exemplified embodiment, the vent tube 200 is positioned within the housing 170 so a first end 201 thereof extends into the opening 132 and an opposite second end 202 thereof extends into the second opening 136 of the divider component 133. As discussed in more detail below, the vent tube 200 may have a passageway extending entirely through it that terminates at openings 208, 209 in each of its opposing ends 201, 202. Thus, the opening 132 places the passageway of the vent tube 200 into spatial communication with the external environment at the first end 201 of the vent tube 200 and the second opening 136 in the divider component 133 places the passageway of the vent tube 200 into spatial communication with external environment via the venting cavity 119 at the second end 202 of the vent tube 200.

The capillary member 180 extends from a first end 183 that is located within the storage cavity 171 and fluidly coupled to the fluid stored in the storage cavity 171 to a second end 184 that is fluidly coupled to the applicator 150. Thus, the capillary member 180 transports the fluid from the storage cavity 171 of the housing 170 to the applicator 150 as described herein. In the exemplified embodiment, the vent tube 200 is aligned with the cavity axis B-B (with the exception of offset portions of the vent tube 200 as described below) and the capillary member 180 is entirely offset relative to the cavity axis B-B. Thus, in the exemplified embodiment the capillary member 180 may extend along a longitudinal axis that is parallel to or slightly angled relative to (up to about 5°) the cavity axis B-B while not being located directly on the cavity axis B-B. In other embodiments, the capillary member 180 may be located on the cavity axis B-B and the vent tube 200 may be offset from the cavity axis B-B.

The capillary member 180 is at least partially located within the storage cavity 171 so that the capillary member 180 is fluidly coupled to the store of the fluid (i.e., liquid) that is located within the storage cavity 171. Specifically, the capillary member 180 has a first portion 181 that includes the first end 183 that is located within the storage cavity 171. The capillary member extends through the first opening 135 in the divider component 133 so that a second portion 182 of the capillary member 180 that includes the second end 184 is located within the venting cavity 119 and the passageway 172 in the neck region 117. More specifically, the capillary member 180 extends from the housing 170 and through the passageway 172 in the neck region 117 of the personal care implement 100 to the applicator 150 so that the capillary member 180 can draw fluid from the store of the fluid in the storage cavity 171 and transport that fluid to the applicator 150 where it can be dispensed at an appropriate time and location.

Figure 6:
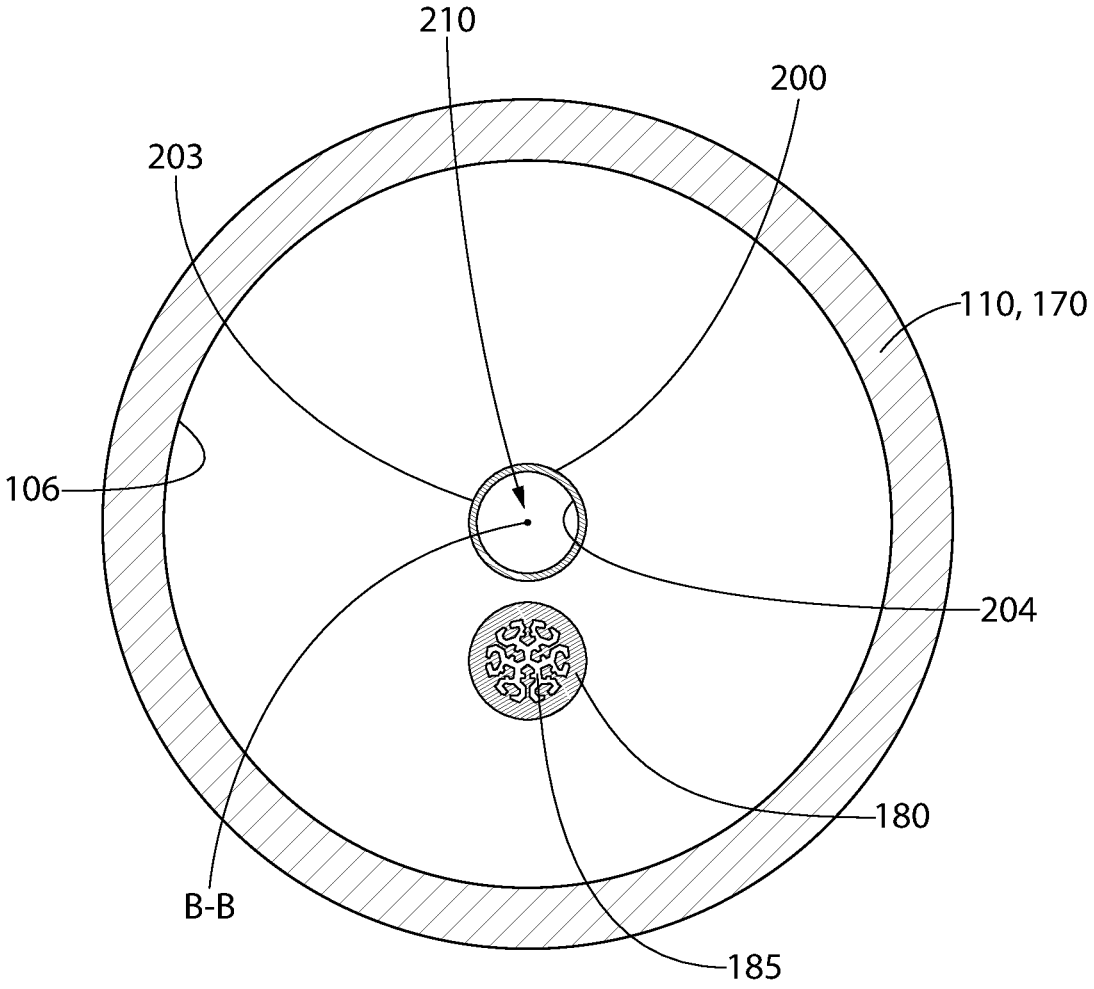
FIG. 6 is a schematic cross-sectional view taken along line VI-VI of FIG. 4.
Figure 7:
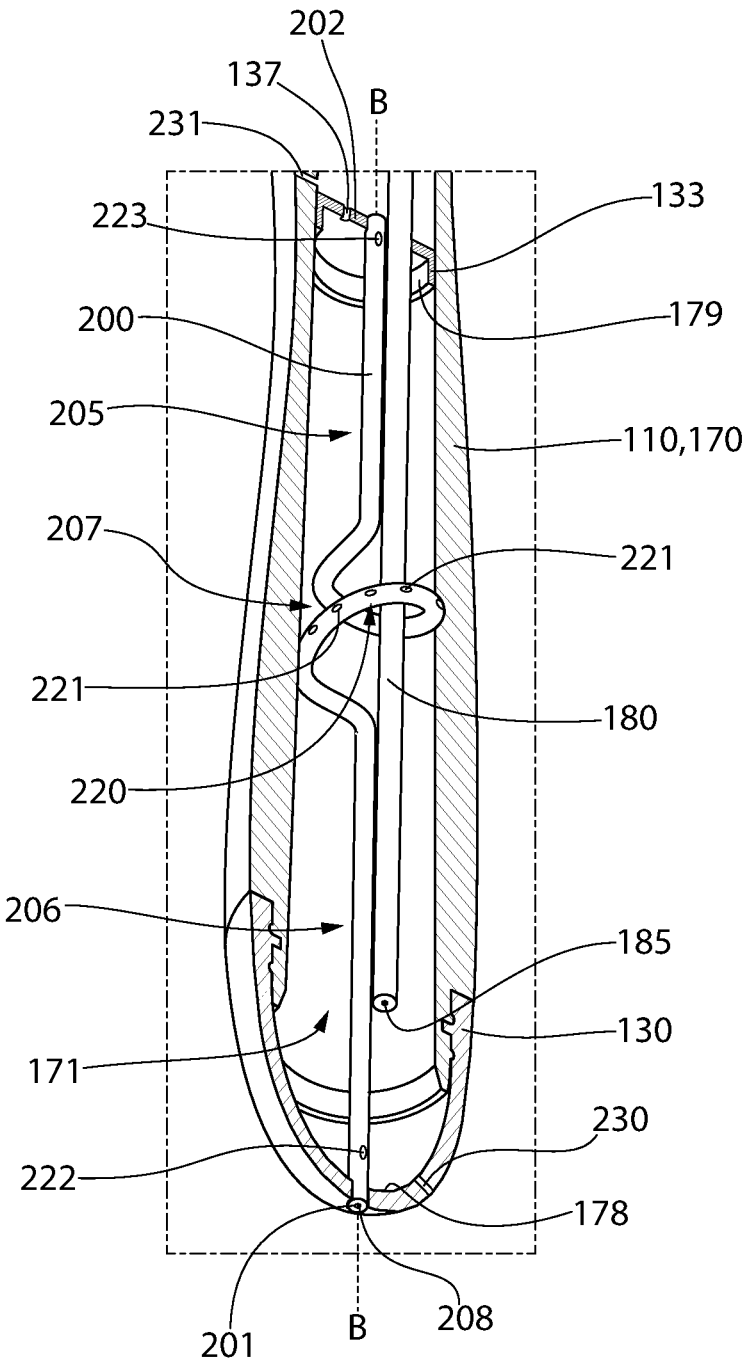
FIG. 7 is a partial cut-away view of a portion of the personal care implement of FIG. 1.
Figure 7A:
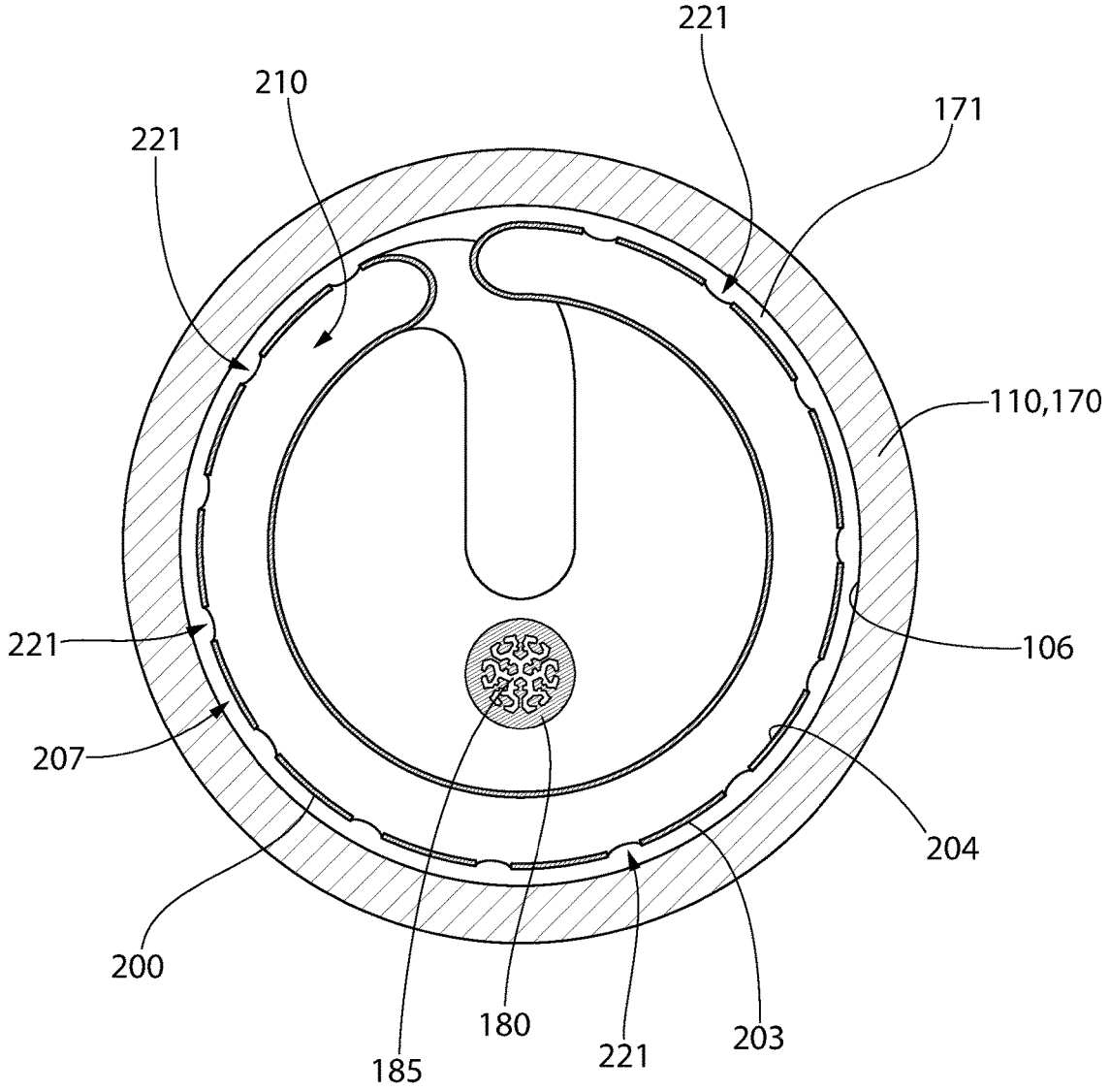
FIG. 7A is a schematic cross-sectional view taken along line VIIA-VIIA of FIG. 4.

In the exemplified embodiment, the capillary member 180 is a capillary tube having a capillary passageway 185 extending entirely through the capillary member 180 from the first end 183 to the second end 184 that permits the fluid to flow within the capillary member 180 from the first end 183 to the second end 184 via a wicking action. Thus, in this manner the fluid is able to flow from its storage location within the storage cavity 171 of the housing 170 to the applicator 150 so that the applicator 150 can be loaded with the fluid. Specifically, the passageway 185 may have a cross-sectional size and shape that permits flow of the fluid all the way from the storage cavity 171 to the applicator 150 to ensure that the applicator 150 remains loaded with the fluid (see, e.g., FIG. 6). In other embodiments, the capillary member 180 may be formed of a porous material, such as any of the materials described above with reference to the applicator 150. In such embodiments the fluid may flow up the capillary member 180 via a wicking action (also referred to herein as capillary action) due to the material of the capillary member 180 (for example if the capillary member 180 is formed from a porous material). In either embodiment, the flow of the fluid occurs naturally via capillary action without the need for a separate pump.

In certain embodiments, the capillary member 180 has a capillary structure which may be formed in numerous configurations and from numerous materials operable to produce fluid flow via capillary action. In one non-limiting embodiment, the capillary member 180 may be configured as a tube or lumen having an internal open capillary passageway extending between ends of the capillary member which is configured and dimensioned in cross section to produce capillary flow. The lumen or open capillary passageway may have any suitable cross sectional shape and configuration. In such embodiments the capillary member 180 may be formed of a porous material as described below or a non-porous material (e.g., plastics such as polypropylene, metal, rubber, or the like). In other non-limiting embodiments, capillary member 180 may be formed of a porous and/or fibrous material of any suitable type through which a fluid can travel via capillary action or flow. Examples of suitable materials include without limitation fibrous felt materials, ceramics, and porous plastics with open cells (e.g. polyurethane, polyester, polypropylene, or combinations thereof) including such materials as those available from Porex Technologies, Atlanta, Ga. The capillary member material may therefore be a porous material, a fibrous material, a foam material, a sponge material, natural fibers, sintered porous materials, porous or fibrous polymers or other materials which conduct the capillary flow of liquids. Of course, the capillary material is not to be limited by the specific materials noted herein in all embodiments, but can be any material that facilitates movement of a liquid therethrough via capillary action. A mixture of porous and/or fibrous materials may be provided which have a distribution of larger and smaller capillaries. The capillary member 180 can be formed from a number of small capillaries that are connected to one another, or as a larger single capillary rod. The capillary member whether formed as a lumen or of porous or fibrous materials may have any suitable polygonal or non-polygonal cross sectional shape including for example without limitation circular, elliptical, square, triangular, hexagonal, star-shaped, etc. The invention is not limited by the construction, material, or shape of the capillary member.

In the exemplified embodiment, the capillary member 180 has openings into the passageway 185 only at the first end 183 thereof and at the second end 184 thereof. There are no other openings along the length of the first portion 181 of the capillary member 180 that permit the fluid to enter into the passageway 185 of the capillary member 180. Thus, the fluid within the storage cavity 171 can only enter into the passageway 185 of the capillary member 180 through the opening in the first end 183 of the capillary member 180. Thus, in certain orientations of the housing 170 and certain fluid levels within the storage cavity 171, the fluid is unable to enter into the passageway 185 of the capillary member 180 because it is not in contact with the opening in the first end 183 of the capillary member 180. Of course, in other embodiments additional openings may be provided in the capillary member 180 through which fluid can enter into the passageway 185 of the capillary member 180.

Referring to FIGS. 3 and 5A-7A concurrently, the vent tube 200 will be described in greater detail. As noted above, the vent tube 200 is at least partially located within the storage cavity 171. Specifically, in the exemplified embodiment the vent tube 200 extends from the first end 201 that extends into the opening 132 at the proximal end 104 of the personal care implement 100 to the second end 202 that extends into the second opening 136 in the divider component 133. Of course, the invention is not to be so limited in all embodiments and in certain other embodiments only one of the first and second ends 201, 202 of the vent tube 200 may extend out of the storage cavity 171. Alternatively, one or both of the first and second ends 201, 202 may extend through an opening in the tubular sidewall 173 of the housing 170. However, the vent tube 200 should extend out of the storage cavity 171 on at least one end thereof because the purpose of the vent tube 200 is to vent the storage cavity 171 to the external atmosphere. As described in more detail below, the vent tube 200 creates an air intake/venting system that allows air to replace the fluid that is dispensed from the storage cavity 171 over time during use and allows air to exit the storage cavity 171 to prevent it from exerting pressure on any fluid in the storage cavity 171.

The vent tube 200 has an outer surface 203 and an inner surface 204. The outer surface 203 of the vent tube 200 forms a generally continuous exterior of the vent tube 200 except that it has vent apertures therein as described in more detail below. The inner surface 204 of the vent tube 200 defines a primary vent passageway 210 that extends entirely through the vent tube 200 from the first end 201 of the vent tube 200 to the second end 202 of the vent tube 200. In the exemplified embodiment, the vent tube 200 has a first opening 208 in the first end 201 thereof and a second opening 209 in the second end 202 thereof. Thus, the primary vent passageway 210 extends from the first opening 208 to the second opening 209. However, in alternative embodiments the vent tube 200 may only include one of the first and second openings 208, 209, but not both. An opening, whether it is one of the first and second openings 208, 209 or some other opening, is needed to be in spatial communication with the exterior atmosphere to facilitate proper operation of the vent tube 200 regardless of the orientation of the housing 170.

The vent tube 200 comprises an upper section 205, a lower section 206, and a middle section 207. Specifically, the upper section 205 is located axially above the middle section 207, which in turn is located axially above the lower section 206. Thus, the upper, lower, and middle sections 205, 206, 207 are each axial sections of the vent tube 200. In the exemplified embodiment, the upper and lower sections 205, 206 are linear sections of the vent tube 200 and they are arranged substantially parallel to the cavity axis B-B. More specifically, in the exemplified embodiment the upper and lower sections 205, 206 of the vent tube 200 are located on the cavity axis B-B. However, the invention is not to be so limited in all embodiments and the upper and lower sections 205, 206 of the vent tube 200 could be offset from but parallel to the cavity axis B-B. Furthermore, in other embodiments the upper and lower sections 205, 206 of the vent tube 200 may be slightly angled relative to the cavity axis B-B. Thus, the term "substantially" with regard to the upper and lower sections 205, 206 of the vent tube 200 being parallel to the cavity axis B-B includes them being slightly angled (up to about 5°) relative to the cavity axis B-B.

The middle section 207 of the vent tube 200 is located axially between the upper and lower sections 205, 206 of the vent tube 200. Furthermore, the middle section 207 of the vent tube 200 is radially offset relative to the upper and lower sections 205, 206 of the vent tube 200. More specifically, in the exemplified embodiment the middle section 207 of the vent tube 200 comprises a helical portion or forms a helical portion of the vent tube 200. Stated another way, in the exemplified embodiment the middle section 207 of the vent tube 200 is a radially offset section of the vent tube 200 that forms a loop that circumferentially surrounds the cavity axis B-B. Thus, within the middle section 207, the vent tube 200 is spaced further from the cavity axis B-B than within the upper and lower sections 205, 206.

The loop formed by the middle section 207 of the vent tube 200 may be oriented oblique to the cavity axis B-B. A portion of the outer surface 203 of the vent tube 200 within the middle section 207 of the vent tube 200 faces the inner surface 106 of the housing 170 in a closely spaced manner (best illustrated in FIG. 7A). Specifically, the portion of the outer surface 203 of the vent tube 200 may be spaced apart from the inner surface 106 of the housing 170 by between 0.5 mm and 2 mm. In the exemplified embodiment, the outer surface 203 of the vent tube 200 within the middle section 207 of the vent tube 200 is spaced further from the cavity axis B-B than the outer surface 203 of the vent tube 200 within the upper and lower sections 205, 206 of the vent tube 200. Maintaining the outer surface 203 of the vent tube 200 in close proximity to the inner surface 106 of the handle 110/housing 170 ensures proper venting regardless of the orientation of the handle 110 and/or the housing 170 by ensuring that a vent aperture of the vent tube 200 is spatially coupled to any air pockets within the storage cavity 171.

Although in the exemplified embodiment the upper and lower sections 205, 206 of the vent tube 200 are linear and parallel to the cavity axis B-B, the invention is not to be so limited in all embodiments. In some alternative embodiments the vent tube 200 may have a helical structure along its entire length such that it is formed by multiple loops each circumferentially surrounding the cavity axis B-B. In some embodiments, it is merely preferable that the vent tube 200 comprise at least one loop or helical portion that surrounds the cavity axis B-B and that has vent apertures therein as described directly below.

The vent tube 200 also comprises a plurality of vent apertures 220, each forming a passageway between the storage cavity 171 and the primary vent passageway 210. Specifically, each of the vent apertures 220 extends through the vent tube 200 from the outer surface 203 thereof to the inner surface 204 thereof. In the exemplified embodiment, the plurality of vent apertures 220 include a plurality of first vent apertures 221 located within the middle section 207 of the vent tube 200, at least one second vent aperture 222 located within the lower section 206 of the vent tube 200, and at least one third vent aperture 223 located within the upper section 205 of the vent tube 200. In the exemplified embodiment, the second vent aperture 222 is located adjacent to the first end 178 of the storage cavity 171 and the third vent aperture 222 is located adjacent to the second end 179 of the storage cavity 170. Furthermore, there may be additional vent apertures located at other locations along the vent tube 200. As will be discussed in greater detail below with reference to FIGS. 8A-8D, in some embodiments the second and third vent apertures 222, 223 could be omitted and venting when the handle 110 and/or the housing 170 are in vertical orientations (upright or upside-down) can be achieved using other apertures or venting means. Thus, in some embodiments the vent tube 200 may only include the first vent apertures 221 within the middle section 207 thereof.

The vent tube 200 and its vent apertures 220 along with some additional vent openings described herein operates as an air intake and venting system to allow air to replace the fluid (i.e., liquid) that is dispensed from the storage cavity 171 over time during use. Specifically, each of the vent apertures 220 forms a passageway from the storage cavity 171 to the primary vent passageway 210 of the vent tube 200, and the primary vent passageway 210 forms a passageway to the external atmosphere as described in more detail below. The loop or helical shape of the vent tube 200 at which the first vent apertures 221 are located ensures that the vent tube 200 is always spatially coupled to any air pockets within the storage cavity 171 to vent the air pockets to the external atmosphere regardless of the orientation of the housing 170. This helps to ensure consistent flow of the fluid during use and prevents uncontrolled fluid leakage regardless of the orientation at which the handle 110 and/or housing 170 is positioned and regardless of changes in temperature and pressure.

In certain embodiments, each of the vent apertures 220 is designed with a specific dimension/size tailored to the physical properties (e.g., viscosity and surface tension) of the fluid/liquid stored within the storage cavity 171 such that once system equilibrium is reached, the fluid cannot pass through the vent apertures 220 under normal usage conditions. Stated another way, each of the vent apertures 220 is configured such that a fluid within the storage cavity 171 cannot flow through the vent apertures 220 at ambient temperature and with a pressure equilibrium existing between the storage cavity 171 and the external atmosphere. However, at the same time the vent apertures 220 are designed to permit gas, such as air, within the storage cavity 171 to pass through the vent apertures 220. Specifically, as long as the vent apertures 220 are not clogged, the gas/air will be capable of freely passing through the vent apertures 220 both into and out of the storage cavity 171 as needed (during periods of compression and expansion or the gas) to provide proper air intake and venting to ensure proper operation of the device (i.e., consistent fluid flow during use) without leakage.

The vent apertures 220 may be configured to prevent the fluid stored within the storage cavity 171 from passing therethrough at ambient temperature and with a pressure equilibrium existing between the storage cavity 171 and the external atmosphere in several ways. First, this may be accomplished by specifically selecting the dimensions of the vent apertures 220, based on the viscosity and surface tension of the fluid, to ensure that the fluid cannot pass through the vent apertures 220 under the conditions noted above. For example without limitation, in one embodiment the vent apertures 220 may have a diameter in a range of 0.05 mm-0.5 mm, and more specifically in a range of 0.1 mm-0.3 mm. Alternatively, the vent apertures 220 may be covered with a selective membrane that permits gas/air to pass therethrough in both directions while preventing the fluid from passing therethrough. In other embodiments, the material of the structure that forms the vent apertures 220 may be selected to prevent the fluid from passing therethrough while permitting gas/air to pass therethrough. Still further, the walls that define/surround the vent apertures 220 may have a jagged shape or the like that prevents fluid from passing therethrough under the conditions identified above. Thus, there are many different ways that the vent apertures 220 can be configured to permit air to flow therethrough while preventing fluid from passing therethrough at ambient temperature and with a pressure equilibrium existing as noted above.

As discussed in greater detail below with reference to FIGS. 8A-8D, the vent apertures 220 are positioned along the vent tube 200 in such a manner that there are no pockets of trapped air within the storage cavity 171, regardless of orientation of the handle 110 and/or housing 170, that can expand due to increases in temperature or decreases in pressure (both of which would exert pressure on the fluid in the storage cavity 171 and cause it to be expelled in an uncontrolled manner). Rather, any air pockets are always spatially coupled to the exterior atmosphere (via the vent apertures 220, the primary vent passageway 210, and handle vent apertures described below) so that as a result of any increases in temperature or decreases in pressure (i.e., expansion of the air/gas), the air/gas in the air pockets will exit the storage cavity 171 rather than exert pressure on the fluid and cause it to leak out of the storage cavity 171. In order to achieve this, at least one of the vent openings 220 may be positioned along the housing 170 at a location that is aligned with a maximum internal diameter of the storage cavity 171.

Thus, in the exemplified embodiment the middle section 207 of the vent tube 200 is located in alignment with the maximum (or near-maximum) internal diameter of the storage cavity 171. Furthermore, the first vent apertures 221 are formed into the portion of the outer surface 203 of the vent tube 200 that faces the inner surface 106 of the handle 110 and/or housing 170. As the orientation of the handle 110/housing 170 changes, the fluid in the storage cavity 171 will move around and the location of the air pockets will change. However, air pockets that form will be located in the regions of the storage cavity 171 that has the maximum internal diameter. Thus, keeping the middle portion 207 of the vent tube 200 in alignment with this maximum internal diameter portion of the storage cavity 171 ensures that one of the first vent apertures 221 is in spatial communication with gas/air pockets of the storage cavity 171. This is described in more detail below with reference to FIGS. 8A-8D.

Although the middle section 207 of the vent tube 200 is described and illustrated herein as being located between the upper and lower sections 205, 206 of the vent tube 200, the invention is not to be so limited in all embodiments. Specifically, in some embodiments it is merely preferable that the section of the vent tube 200 that forms a loop that surrounds the cavity axis B-B be aligned with a region of the storage cavity 171 that has the maximum or near-maximum diameter of the storage cavity 171. The maximum or near-maximum diameter region of the storage cavity 171 could be located closer to the first end 178 of the storage cavity 171 or closer to the second end 179 of the storage cavity, and in such case the location of the loop portion of the vent tube 200 could be moved accordingly to coincide with this maximum or near-maximum diameter region of the storage cavity 171. The region of the storage cavity 171 with the maximum diameter is the region in which air pockets are most likely to form. The loop portion of the vent tube 200 with the first apertures 221 therein should be aligned with or located within the region of the storage cavity 171 with the maximum or near-maximum diameter to ensure that the location of the first apertures 221 coincides with the air pockets within the storage cavity 171.

In some embodiments, the second vent apertures 222 permit proper venting of the storage cavity 171 when the housing 170 is in an upright orientation and the plurality of first vent apertures 221 and the third vent apertures 223 are submerged by the fluid in the storage cavity 171. The third vent apertures 223 permit proper venting of the storage cavity 171 when the housing 211 is in a vertical but inverted orientation and the plurality of first vent apertures 221 and the second vent apertures 222 are submerged by the fluid in the storage cavity 171. The plurality of first vent apertures 221 permit proper venting of the storage cavity 171 when the second and third vent apertures 222, 223 are submerged by the fluid in the storage cavity 171 but at least one of the plurality of first vent apertures 221 remains outside of the fluid in the storage cavity 171. In every instance that the second and third vent apertures 222, 223 are covered by the fluid in the storage cavity 171, regardless of the specific orientation of the housing 170, at least one of the first vent apertures 221 will be located outside of the fluid so that it is spatially coupled to the gas within the storage cavity 171. Thus, in certain embodiments, regardless of the orientation of the housing 170 there remains one vent aperture 221, 222, 223 of the vent tube 200 available for venting the storage cavity 171 which assists in preventing fluid leaks.

The plurality of first vent apertures 221 are arranged along the middle section 207 of the vent tube 200 in a spaced apart manner. In the exemplified embodiment, the first vent apertures 221 are both axially and angularly equi-spaced from one another. More specifically, in the exemplified embodiment adjacent ones of the first vent apertures 221 are separated by an angle that is less than or equal to sixty degrees, more specifically less than or equal to 50 degrees, more specifically less than or equal to 40 degrees, more specifically less than or equal to 30 degrees, more specifically less than or equal to 20 degrees, and more specifically less than or equal to 10 degrees. However, the exact spacing between adjacent ones of the first vent apertures 221 may be modified in alternative embodiments. Furthermore, the first vent apertures 221 need not be equi-spaced in all embodiments and adjacent first vent apertures 221 may have variations in spacing in alternative embodiments (i.e., a first of the first vent apertures 221 that is adjacent to a second and a third of the first vent apertures 221 may be in closer to proximity the second of the first vent apertures 221 than to the third of the first vent apertures 221).

In the exemplified embodiment, the first vent apertures 221 are arranged in a spaced-apart manner to circumferentially surround the cavity axis B-B of the storage cavity 171 of the housing 170. Furthermore, each of the first vent apertures 221 is radially spaced from the cavity axis B-B so as to be located adjacent to the sidewall 173 of the housing 171. In the exemplified embodiment, the first vent apertures 221 are arranged in a helical pattern about the cavity axis B-B, but in other embodiments the first vent apertures 221 may circumferentially surround the cavity axis B-B without forming a helical pattern. So long as the functionality described herein is achieved so that one of the vent apertures 221, 222, 223 is in spatial communication with the air/gas within the storage cavity 171 regardless of the orientation of the storage cavity 171, the exact location, number, and spacing of the plurality of first vent apertures 221 is not to be limiting of the present invention in all embodiments.

Although the vent tube 200 may achieve all of the venting of the storage cavity 171 in some embodiments, the invention is not to be so limited. Specifically, in some other embodiments some of the venting may be achieved via the vent apertures 220 in the vent tube 200 and additional venting may be achieved with other vent apertures not formed into the vent tube 200. Specifically the body 101, and more specifically the handle 110 (or the housing 170) may include a vent opening 230 in or near the proximal end 104 of the personal care implement 100. The vent opening 230 extends from the inner surface 106 of the handle 110 to an outer surface 107 of the handle 110. In the exemplified embodiment the vent opening 230 is formed into the end cap 130, but the invention is not to be so limited. The vent opening 230 forms a passageway from the storage cavity 171 directly to the exterior atmosphere.

Furthermore, in the exemplified embodiment the vent opening 137 in the divider component 133 also operates as an air vent. The vent opening 137 forms a passageway from the storage cavity 171 to the venting cavity 119. Furthermore, in this embodiment a handle vent aperture 231 is formed into the handle 110 within the venting cavity 119. The handle vent aperture 231 forms a passageway from the venting cavity 119 to the exterior atmosphere. Thus, if air in the storage cavity 171 expands and flows through the vent opening 137 in the divider component 133 and into the venting cavity 119, it can also flow from the venting cavity 119 to the external atmosphere via the handle vent aperture 231 to achieve the desired venting of the storage cavity 171.

In the exemplified embodiment the handle vent aperture 231 is oriented orthogonal to the longitudinal axis A-A of the personal care implement 100. However, in other embodiments the handle vent aperture 231 may be oriented oblique to the longitudinal axis A-A of the personal care implement 100 (and to the cavity axis B-B) to limit blockage or clogging of the handle vent aperture 231 by preventing debris from entering into the handle vent aperture 231.

The vent opening 230 and the vent opening 137 are designed similar to the vent apertures 220 in the vent tube 200 in that they are configured such that a fluid within the storage cavity 171 cannot flow through the vent opening 230 and the vent opening 137 at ambient temperature and with a pressure equilibrium existing between the storage cavity 171 and the external atmosphere. However, at the same time the vent opening 230 and the vent opening 137 are designed to permit gas, such as air, within the storage cavity 171 to pass through the vent opening 230 and the vent opening 137. Specifically, as long as the vent opening 230 and the vent opening 137 are not clogged, the gas/air will be capable of freely passing through the vent opening 230 and the vent opening 137 both into and out of the storage cavity 171 as needed to provide proper air intake and venting to ensure proper operation of the device (i.e., consistent fluid flow during use) without leakage. This can be accomplished by changing the size, shape, and material of the vent openings 230, 137 and/or by covering the vent openings 230, 137 with a selective membrane as described above with reference to the vent apertures 220.

In the exemplified embodiment, a passageway exists from the storage cavity 171 to the external atmosphere as follows: (1) from the storage cavity 171 through one of the first, second, and third vent openings 221, 222, 223 in the vent tube 200 and into the primary vent passageway 210 of the vent tube 200, and then either directly out the first opening 208 in the vent tube 200 to the external atmosphere or out the second opening 209 in the vent tube 200 to the venting cavity 119 and then through the handle vent aperture 231 to the external atmosphere; (2) from the storage cavity 171 through the vent opening 137 in the divider component 133 to the venting cavity 119, and then through the handle vent aperture 231 to the external atmosphere; and (3) through the vent opening 230 directly to the external atmosphere. Thus, as long as at least one of the first, second, and third vent openings 221, 222, 223, the vent opening 230, or the vent opening 137 is located in spatial communication with the air/gas within the storage cavity 171 (as opposed to being in spatial communication with fluid in the storage cavity 171), the storage cavity 171 is properly vented to substantially prevent fluid leaks as has been described herein. Furthermore, in some embodiments the second and third vent openings 222, 223 may be omitted and in other embodiments the vent opening 230 and/or the vent opening 137 may be omitted. However, in certain embodiments at least one of the second vent opening 222 and the vent opening 230 is included to permit venting of air/gas from the first end 178 of the storage cavity 171 and in certain embodiments at least one of the third vent opening 223 and the vent opening 137 is included to permit venting of air/gas from the second end 179 of the storage cavity 171.

Referring now to FIGS. 8A-8D, operation of the fluid supply apparatus 1000 of the personal care implement 100 will be described. It should be appreciated that the functionality described herein can be utilized with a stand-alone cartridge that operates independently or upon insertion into an interior cavity of a personal care implement 100 as described above. In certain embodiments, the vent apertures 221, 222, 223 are located and arranged on the vent tube 200 such that irrespective of the vertical and angular orientation of the housing 170 relative to a gravitational vector GV, at least one of the vent apertures 221, 222, 223, the vent opening 137, and the vent opening 230 is in spatial communication with a gas 109 located within the storage cavity 171 of the housing 170 rather than with a fluid located within the storage cavity 171 of the housing 170. Thus, in certain embodiments the vent tube 200 achieves proper venting in some orientations of the housing 170 whereas the vent opening 137 and/or the vent opening 230 achieve proper venting in other orientations of the housing 170. As used herein, the gravitational vector GV is a vector illustrating the direction of the force of gravity applied to the housing 170 at a given orientation of the housing 170.

Figure 8A:
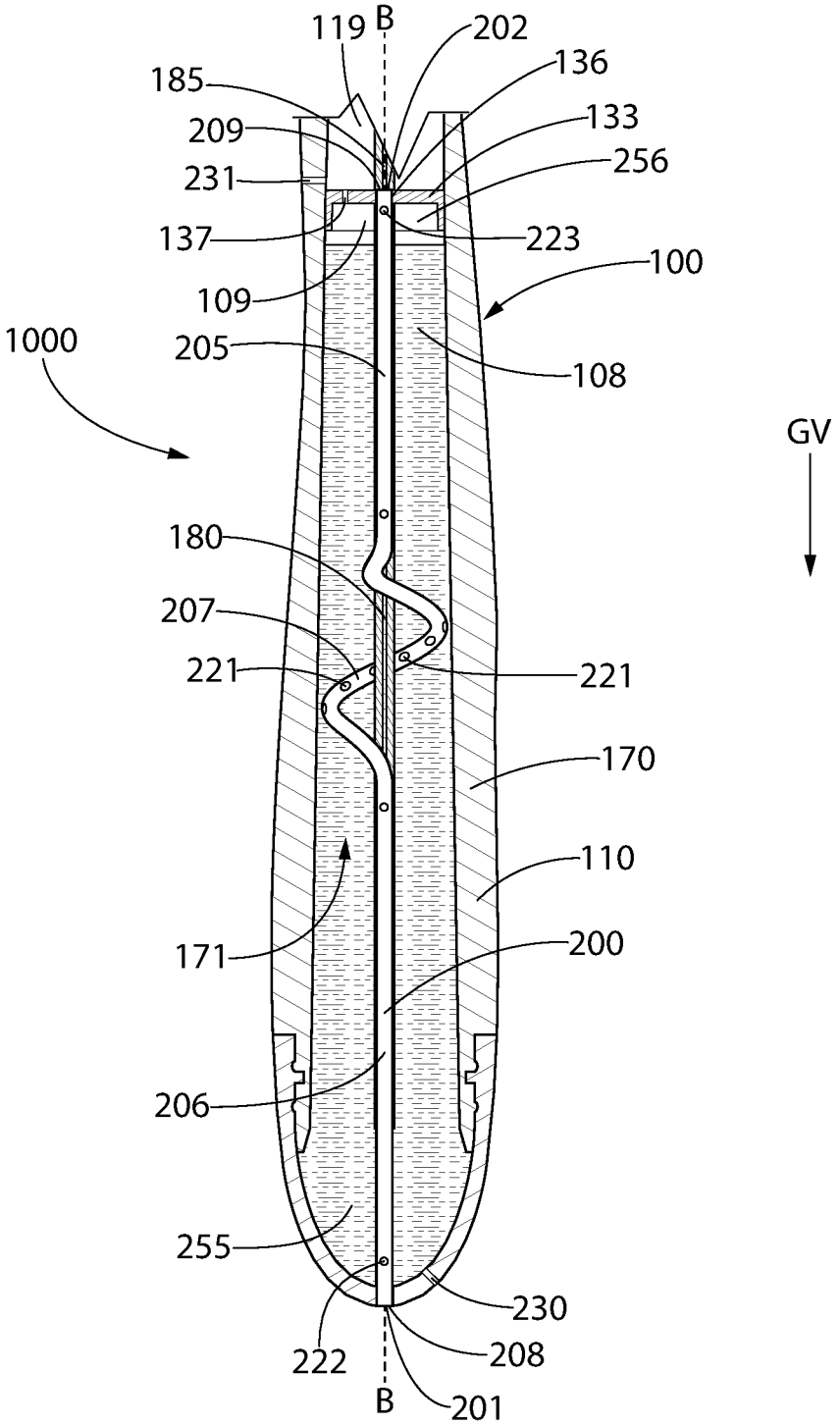
FIG. 8A is a close-up view of area VIII of FIG. 5B with fluid in a storage cavity and with the personal care implement in a first orientation.

FIG. 8A illustrates the housing 170 positioned in an upright orientation. As shown here, the storage cavity 171 of the housing 170 has a total volume that is occupied by a fluid 108 and a gas 109. As noted above, as used herein the term fluid is intended to refer to a liquid and is intended to exclude gases. Thus, the term fluid includes materials that are in liquid form and not materials that are in gaseous form. Thus, the total volume of the storage cavity 171 is occupied collectively by the fluid 108 (which is a liquid) and the gas 109.

In the exemplified embodiment, a first portion of the total volume of the storage cavity 171 of the housing 170 is occupied by the fluid 108 and a second portion of the total volume of the storage cavity 171 of the housing 170 is occupied by the gas 109. In the exemplified embodiment, the first portion of the total volume of the storage cavity 171 that is occupied by the fluid 108 is a majority of the total volume such that the fluid occupies a majority of the total volume of the storage cavity 171. In one embodiment, the fluid 108 occupies at least eighty percent (80%) of the total volume of the storage cavity 171. In another embodiment, the fluid 108 occupies at least eight-five percent (85%), or at least ninety percent (90%) or at least ninety-five percent (95%) of the total volume of the storage cavity 171. Of course, as the fluid 108 is dispensed during use of the device, the fluid 108 contained within the storage cavity 171 becomes depleted and the percentage of the total volume that is taken up by the fluid 108 decreases while the percentage of the total volume that is taken up by the gas 109 increases. This results in increased venting because more of the vent apertures/openings are in spatial communication with the gas 109 than the fluid 108 as the fluid 108 becomes depleted and takes up less of the total volume of the storage cavity 171.

In one specific embodiment, the total volume of the storage cavity 171 may be between 5 ml and 10 ml, more specifically between 6 ml and 8 ml, and still more specifically approximately 7 ml. Furthermore, in certain embodiments prior to use the fluid 108 will encompass approximately 95% (about 6.7 ml when the total volume is 7 ml) of the total volume. Of that 6.7 ml of the fluid 108, a portion will prime the capillary member 180 and the applicator 150, leaving approximately 6 ml of the fluid 108 within the storage cavity 171 (based on the storage cavity 171 having a total volume of 7 ml, the exact numbers may change while the percentages may remain the same). Thus, after priming and at or before first use by an end user, between 80%-90%, and more specifically approximately 85% of the total volume of the storage cavity 171 will be taken up by the fluid 108, the remaining 10%-20%, and more specifically 15%, being taken up by the gas/air 109.

With the housing 170 positioned in the upright orientation such that the gravitational vector GV is parallel to the cavity axis B-B, the fluid 108 in the storage cavity 171 is located in a bottom portion 255 of the storage cavity 171 and the gas 109 is located in a top portion 256 of the storage cavity 171 above the free surface of the fluid 108. In this example and orientation of the housing 170, the third vent aperture 223 of the vent tube 200 and the vent opening 137 of the divider component 133 are in spatial communication with the gas 109 in the storage cavity 171 while the first and second vent apertures 221, 222 of the vent tube 200 and the vent opening 230 are submerged in the fluid 108. Thus, if there were an increase in temperature or a decrease in pressure, the gas 109 will flow out of the storage cavity 171 in at least one of the following manners: (1) through the third vent aperture 223 of the vent tube 200 into the primary vent passageway 210, through the second opening 209 in the vent tube 200 into the venting cavity 119, and then out to the external atmosphere through the handle vent aperture 231; and/or (2) through the vent opening 137 of the divider component 133 into the venting cavity 119 and then out to the external atmosphere through the handle vent aperture 231. Thus, because the third vent aperture 223 of the vent tube and/or the vent opening 137 of the divider component 133 are in spatial communication with the gas 109 (i.e., air pocket) within the storage cavity 171, the gas 109 is permitted to pass to the external atmosphere rather than having it exert a pressure on the fluid 108 which could create a leak situation.

In certain embodiments, either the third vent aperture 223 of the vent tube 200 or the vent opening 137 of the divider component 133 could be omitted. Thus, there only needs to be one vent aperture available for the gas 109 to vent through when the housing 170 is in the upright vertical orientation illustrated in FIG. 8A. However, including both the third vent aperture 223 of the vent tube 200 and the vent opening 137 of the divider component 133 may be preferable in some embodiments for redundancy and may be beneficial because even if one of them becomes clogged operation will not be affected.

In certain embodiments, the gas 109 in the storage cavity 171 is air (i.e., oxygen, a mixture of oxygen, nitrogen, and small amounts of other gases, or the like). Furthermore, the fluid 109 can be any fluid, particularly liquid, that is desired to be dispensed for application to a surface (such as a biological surface) depending on the end use. For example, when the desired application site is a user's oral cavity, the fluid 108 may be one that provides a benefit to a user's oral surfaces (i.e., a benefit agent) such as a sensorial or therapeutic benefit. For example without limitation, the fluid 108 may be a mouthwash, a dentifrice, a tooth whitening agent such as peroxide containing tooth whitening compositions, or the like. Other contemplated fluids that can be stored in the storage cavity 171 include, for example without limitation, antibacterial agents; oxidative or whitening agents; enamel strengthening or repair agents; tooth erosion preventing agents; tooth sensitivity ingredients; gum health actives; nutritional ingredients; tartar control or anti-stain ingredients; enzymes; sensate ingredients; flavors or flavor ingredients; breath freshening ingredients; oral malodor reducing agents; anti-attachment agents or sealants; diagnostic solutions; occluding agents, dry mouth relief ingredients; catalysts to enhance the activity of any of these agents; colorants or aesthetic ingredients; and combinations thereof. In certain embodiments the oral care material is free of (i.e., is not) toothpaste. Instead, the oral care material in such embodiments is intended to provide benefits in addition to merely brushing one's teeth. Other suitable oral care materials could include lip balm or other materials that are typically available in a semi-solid state. Furthermore, in still other embodiments the first fluid 103 can be a natural ingredient, such as for example without limitation, lotus seed; lotus flower, bamboo salt; jasmine; corn mint; camellia; aloe; gingko; tea tree oil; xylitol; sea salt; vitamin C; ginger; cactus; baking soda; pine tree salt; green tea; white pearl; black pearl; charcoal powder; nephrite or jade and Ag/Au+.

Thus, when the fluid 108 is stored in an oral care implement or toothbrush, any of the above fluids may be desirable for use as the fluid 108. In other embodiments the personal care implement 100 may not be a toothbrush. Thus, the fluid 108 can be any other type of fluid that has beneficial results when dispensed in accordance with its end use or the end use of the product/implement with which it is associated. For example, the fluid 108 may be hair gel when the implement is a hairbrush, make-up (i.e., mascara or the like) when the implement is a make-up applicator, shaving cream when the implement is a razor, anti-acne cream when the implement is a skin or face scrubber, or the like. Furthermore, as described herein in some embodiments the fluid supply apparatus 1000 may not be associated with a personal care implement at all. Thus, the fluid 108 may be modified to be any type of fluid that is desired to be dispensed in accordance with the teachings set forth herein even if it is dispensed directly from the fluid supply apparatus 1000 rather than through a personal care implement 100.

In FIGS. 8A-8D, the vent apertures 221 appear to be located on the inner surface of the vent tube 200. This is done for ease of understanding regarding the location of the vent apertures 221. Although the vent apertures 221 could be positioned as illustrated in some embodiments, in other embodiments the vent apertures 221 are on the outer surface 203 of the vent tube 200 facing the inner surface of the body 110 as discussed above and specifically illustrated in FIG. 7A.

Figure 8B:
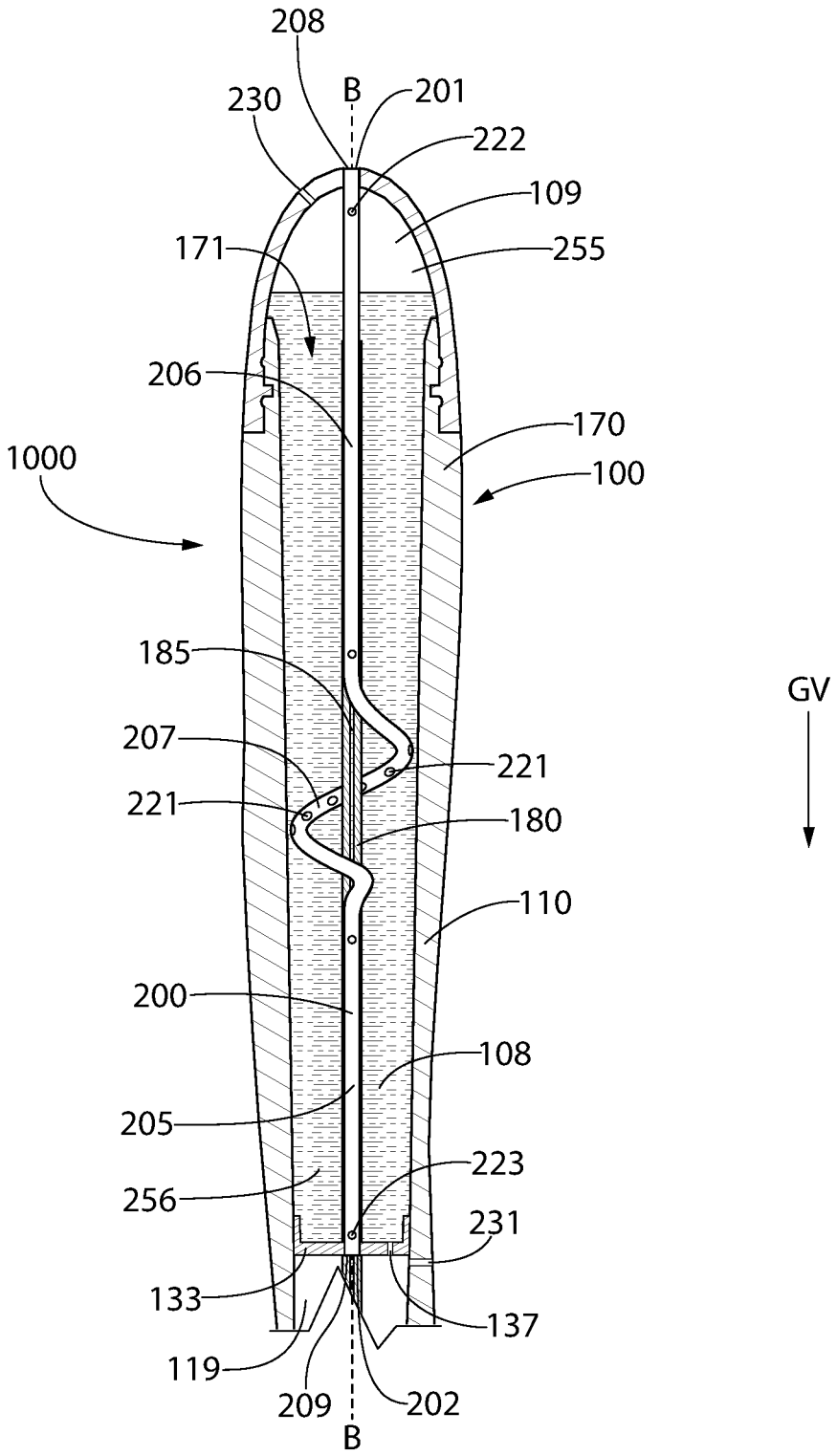
FIG. 8B is a close-up view of area VIII of FIG. 5B with fluid in the storage cavity and with the personal care implement in a second orientation.

FIG. 8B illustrates the same thing as FIG. 8A except the housing 170 has been flipped 180° so that it is upside-down relative to FIG. 8A. Thus, in this embodiment the cavity axis B-B remains parallel to the gravitational vector GV, except here the housing 170 is in an upside-down vertical orientation such that the top portion 256 of the storage cavity 171 is facing downward and the bottom portion 255 of the storage cavity is facing upward. In this embodiment, the same amount of the total volume of the storage cavity 171 is occupied by the fluid 108 and the gas 109 as with the embodiment of FIG. 8A (i.e., a majority of the total volume is occupied by the fluid 108 and the remainder by the gas 109).

With the housing 170 positioned in the upside-down vertical orientation, the fluid 108 in the storage cavity 171 is located in the top portion 256 of the storage cavity 171 (which faces downward) and the gas 109 is located in the bottom portion 255 of the storage cavity 171 (which is above the free surface of the liquid 108 due to the upside-down orientation). In this example and orientation of the housing 170, the second vent aperture 222 of the vent tube 200 and the vent opening 230 are in spatial communication with the gas 109 in the storage cavity 171 while the first and third vent apertures 221, 223 and the vent opening 137 are submerged in the fluid 108. Thus, if there were an increase in temperature or a decrease in pressure, the gas 109 will flow out of the storage cavity 171 in at least one of the following manners: (1) through the second vent aperture 222 of the vent tube 200 into the primary vent passageway 210, and then through the first opening 208 in the vent tube 200 to the external atmosphere; and/or (2) through the vent opening 230 in the housing 170 directly out to the external atmosphere. Thus, because the second vent aperture 221 of the vent tube and/or the vent opening 230 are in spatial communication with the gas 109 (i.e., air pocket) within the storage cavity 171, the gas 109 is permitted to pass to the external atmosphere rather than having it exert a pressure on the fluid 108 which could create a leak situation.

In certain embodiments, either the second vent aperture 222 of the vent tube 200 or the vent opening 230 could be omitted. Thus, there only needs to be one vent aperture available for the gas 109 to vent through when the housing 170 is in the upside-down vertical orientation illustrated in FIG. 8B. However, including both the second vent aperture 223 of the vent tube 200 and the vent opening 230 may be preferable in some embodiments for redundancy and may be beneficial because even if one of them becomes clogged operation will not be affected.

Figure 8C:
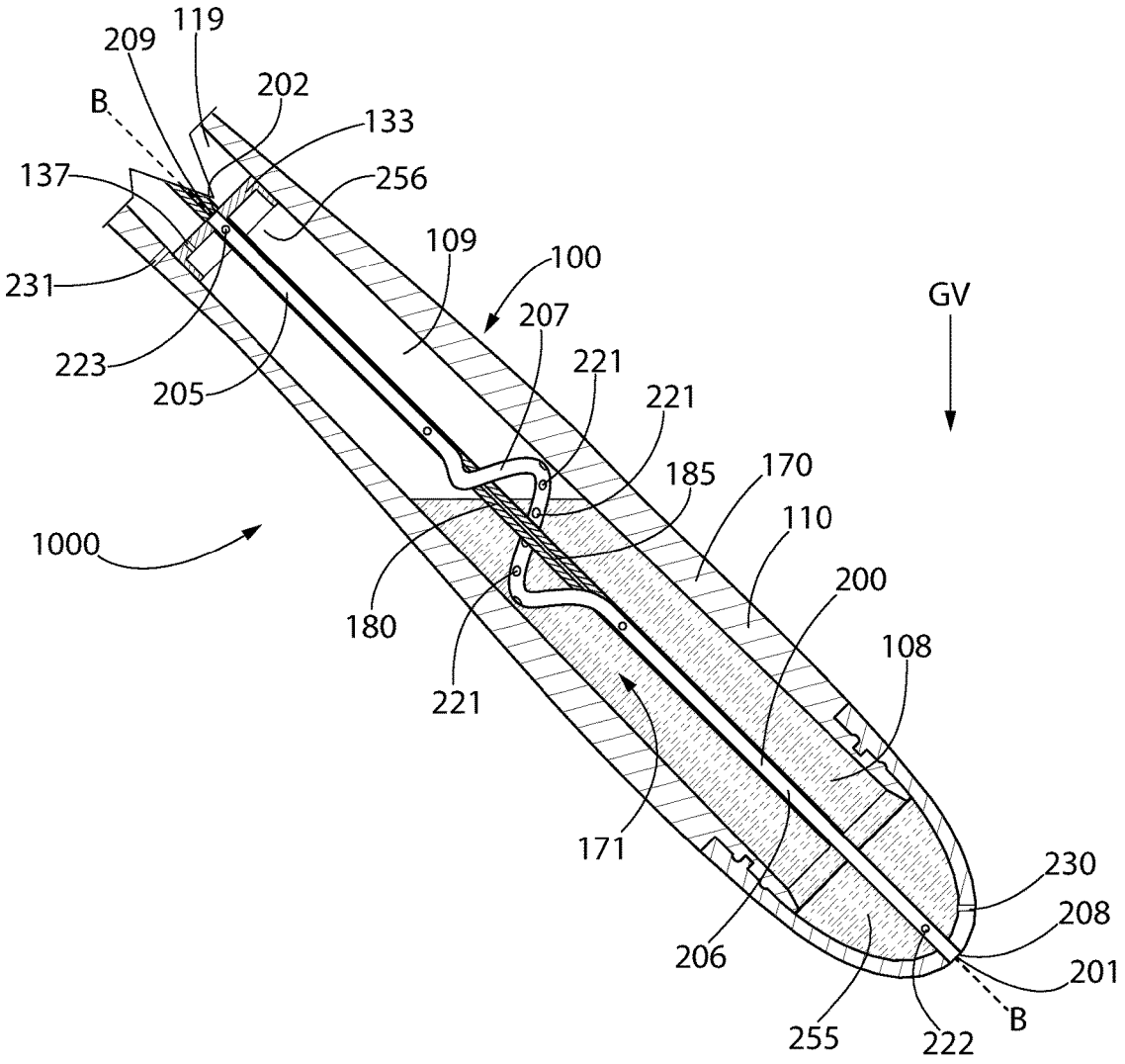
FIG. 8C is a close-up view of area VIII of FIG. 5B with fluid in the storage cavity and with the personal care implement in a third orientation.

FIG. 8C illustrates the same thing as FIGS. 8A and 8B except the housing 170 has been tilted so that the cavity axis B-B is oriented obliquely to the gravitational vector GV. Although one tilt orientation is illustrated in FIG. 8C, the device will operate similarly in any of the infinite tilt orientations at which the cavity axis B-B is oblique to the gravitational vector GV. Furthermore, at any orientation shown (including those shown in any of FIGS. 8A-8D and any of the other infinite orientations), the housing 170 can be rotated (with the cavity axis B-B as the rotational axis) 360° with the device still properly functioning to prevent a leak situation. In the embodiment of FIG. 8C, there is less of the fluid 108 in the storage cavity 171 than in the embodiments of FIGS. 8A and 8B to illustrate the first vent apertures 221 being in spatial communication with the gas 109 in the storage cavity 171 as discussed below.

With the housing 170 positioned in this tilted orientation and the fluid level as shown, the gas 109 in the storage cavity 171 is located in the top portion 256 of the storage cavity 171, but there is more of the gas 109 than with previous embodiments so the gas 109 is present to about half way down the storage cavity 171. In this example and orientation of the housing 170, in addition to the third vent aperture 223 of the vent tube and the vent opening 137 being in spatial communication with the gas 109 in the storage cavity 171, one of the first vent apertures 221 is also in spatial communication with the gas 109 in the storage cavity 171. Thus, if there were an increase in temperature or a decrease in pressure, in addition to being able to flow out of the storage cavity 171 to the external atmosphere through the third vent aperture 223 and/or the vent opening 137 as discussed above with reference to FIG. 8A, the gas 109 will also be able to flow out of the storage cavity 171 through one of the first vent apertures 221. Specifically, as an additional route, the gas 109 could flow from the storage cavity 171 through one or more of the first vent apertures 221 into the primary vent passageway 210 of the vent tube 200, and then through the primary vent passageway 210 of the vent tube and to the external atmosphere in at least one of the following flow paths: (1) out through the first opening 208 of the vent tube 200 directly to the external atmosphere; and/or (2) out through the second opening 209 of the vent tube 200 into the venting cavity 119, and then out from the venting cavity 119 to the external atmosphere via the handle vent aperture 231.

Figure 8D:
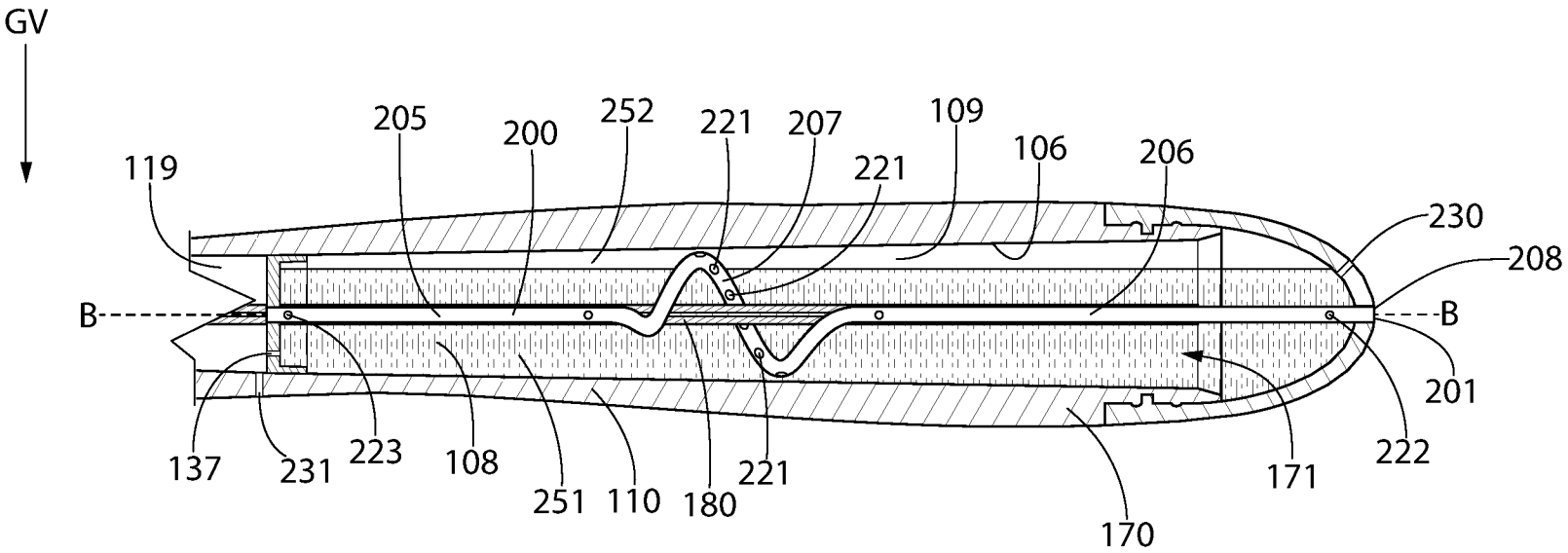
FIG. 8D is a close-up view of area VIII of FIG. 5B with fluid in the storage cavity and with the personal care implement in a fourth orientation.

FIG. 8D illustrates the same thing as FIGS. 8A-8C except the housing 170 has been tilted so that the cavity axis B-B is oriented orthogonal to the gravitational vector GV. With the housing 170 positioned in this orientation, the fluid 108 in the storage cavity 171 falls by gravity to the left-side portion 251 of the storage cavity 171 (illustrated as the bottom due to the orientation of the housing 170 in FIG. 8D) and the right-side portion 252 of the storage cavity 171 (illustrated as the top due to the orientation of the housing in FIG. 8D) is filled with the gas 109. In this example and orientation of the housing 170, the second and third vent apertures 222, 223 of the vent tube 200 and the vent openings 137, 230 are all submerged in the fluid and thus are not in spatial communication with the gas 109 in the storage cavity 171.

However, in this orientation of the housing 170, at least one of the first vent apertures 221 is in spatial communication with the gas 109 in the storage cavity 171. This occurs due to the fact that the first vent apertures 221 are formed into the middle section 207 of the vent tube 200 that has the loop or helical portion of the vent tube 200. Thus, the first vent apertures 221 are located adjacent and near to the inner surface 106 of the housing 170 in a 360° loop to ensure that at least one of the first vent apertures 221 is in spatial communication with the gas 109 in the storage cavity 171.

Thus, with the housing 170 in the horizontal orientation of FIG. 8D, if there were an increase in temperature or a decrease in pressure, the gas 109 will flow out of the storage cavity 171 as follows: (1) first the gas 109 will flow from the storage cavity 171 through at least one of the first vent apertures 221 into the primary vent passageway 210; (2) then the gas 109 will flow within the primary vent passageway 210 in at least one of (a) through the first opening 208 in the vent tube 200 directly to the external atmosphere; and (b) through the second opening 209 in the vent tube 200 into the venting cavity 119, and from the venting cavity 119 to the external atmosphere via the handle vent aperture 231. Thus, because one of the first vent apertures 221 is in spatial communication with the gas (i.e., air pocket) within the storage cavity 171, the gas 109 is permitted to pass to the external atmosphere rather than having it exert a pressure on the fluid 108 which could create a leak situation.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A fluid supply apparatus comprising:

a housing defining a storage cavity having a total volume, the storage cavity extending along a cavity axis from a first end to a second end;

a store of a fluid in the storage cavity and occupying a portion of the total volume, a remaining portion of the total volume occupied by a gas;

a capillary member in fluid coupling with the store of the fluid, the capillary member extending through the housing;

a vent tube comprising a primary vent passageway and a plurality of vent apertures, each of the vent apertures forming a passageway between the storage cavity and the primary vent passageway, the primary vent passageway forming a pathway between each of the vent apertures and an external atmosphere, and the vent apertures configured such that the fluid cannot flow through the vent apertures at ambient temperature and pressure equilibrium between the storage cavity and the external atmosphere; and the vent apertures located and arranged on the vent tube such that irrespective of vertical and angular orientation of the housing relative to a gravitational vector at least one of the vent apertures is in spatial communication with the gas.

2. The fluid supply apparatus according to claim 1 wherein the store of the fluid occupies a majority of the total volume.

3. The fluid supply apparatus according to claim 1 wherein the vent apertures comprise a plurality of first vent apertures radially spaced from the cavity axis and arranged in a spaced apart manner to circumferentially surround the cavity axis.

4. The fluid supply apparatus according to claim 3 wherein the first vent apertures are located adjacent a sidewall of the housing.

5. The fluid supply apparatus according to claim 3 wherein the first vent apertures are located on a radially offset section of the vent tube.

6. The fluid supply apparatus according to claim 5 wherein the radially offset section of the vent tube comprises a helical portion.

7. The fluid supply apparatus according to claim 6 wherein the first vent apertures are arranged in a helical pattern about the cavity axis on the helical portion.

8. The fluid supply apparatus according to claim 5 wherein the radially offset section of the vent tube is located in an axial middle-section of the storage cavity.

9. The fluid supply apparatus according to claim 1 wherein the vent apertures comprise at least one second vent aperture located adjacent the first end of the storage cavity and at least one third vent aperture located adjacent the second end of the storage cavity.

10. The fluid supply apparatus according to claim 9 wherein the vent tube comprises an upper section and a lower section, the second vent aperture located on the lower section and the third vent aperture located on the upper section.

11. The fluid supply apparatus according to claim 10 wherein each of the upper and lower sections of the vent tube are linear and arranged substantially parallel to the cavity axis.

12. The fluid supply apparatus according to claim 1 wherein the vent tube extends through the housing.

13. The fluid supply apparatus according to claim 12 wherein the primary vent passageway of the vent tube terminates in an opening at an end of the vent tube.

14. An oral care implement comprising the fluid supply apparatus according to claim 1.

15. The oral care implement according to claim 14 further comprising:

a head;

a handle; and an applicator in fluid coupling with the capillary member, wherein the applicator is located on the head;

wherein the housing forms a portion of the handle, the housing comprising a tubular sidewall that forms a gripping section of the handle; a first end wall that forms a proximal end of the handle; and a second end wall located within the handle; and wherein the second end wall separates the storage cavity from a venting cavity, the venting cavity located within the handle and the primary vent passageway in spatial communication with the venting cavity, and at least one handle vent aperture forming a passageway between the venting cavity and the external atmosphere.

16. A fluid supply apparatus comprising:

a housing defining a storage cavity extending along a cavity axis from a first end to a second end;

a capillary member having a portion in the storage cavity and a portion extending through the housing;

a vent tube comprising a primary vent passageway and a plurality of vent apertures, each of the vent apertures forming a passageway between the storage cavity and the primary vent passageway, the primary vent passageway forming a pathway between each of the vent apertures and an external atmosphere, the vent apertures comprising a plurality of first vent apertures radially spaced from the cavity axis and arranged in a spaced apart manner to circumferentially surround the cavity axis.

17. The fluid supply apparatus according to claim 16 wherein the first vent apertures are located adjacent a sidewall of the housing.

18. The fluid supply apparatus according to claim 16 wherein the first vent apertures are located on a radially offset section of the vent tube.

19. The fluid supply apparatus according to claim 18 wherein the radially offset section of the vent tube forms a loop.

20. The fluid supply apparatus according to claim 18 wherein the radially offset section of the vent tube comprises a helical portion.

* * * * *